US009650221B2

(12) United States Patent
Kawamata et al.

(10) Patent No.: US 9,650,221 B2
(45) Date of Patent: May 16, 2017

(54) CONVEYOR

(71) Applicant: BROTHER KOGYO KABUSHIKI KAISHA, Nagoya-shi, Aichi-ken (JP)

(72) Inventors: Noriyuki Kawamata, Nagoya (JP); Yasuhira Ota, Yatomi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/658,823

(22) Filed: Mar. 16, 2015

(65) Prior Publication Data

US 2015/0266686 A1 Sep. 24, 2015

(30) Foreign Application Priority Data

Mar. 19, 2014 (JP) ..... 2014-056201

(51) Int. Cl.
*B65H 5/02* (2006.01)
*B65H 7/06* (2006.01)
(Continued)

(52) U.S. Cl.
CPC ..... *B65H 7/06* (2013.01); *B65H 3/0669* (2013.01); *B65H 3/0684* (2013.01); *B65H 5/062* (2013.01); *B65H 9/008* (2013.01); *B65H 2402/441* (2013.01); *B65H 2402/46* (2013.01); *B65H 2403/422* (2013.01); *B65H 2403/513* (2013.01); *B65H 2403/942* (2013.01);
(Continued)

(58) Field of Classification Search
CPC ..... B65H 2404/142; B65H 2404/143; B65H 2404/144; B65H 2404/1441; B65H 2404/1442; B65H 2404/1253; B65H 2404/253; B65H 2404/2532; B65H 2301/4474; B65H 29/20; B65H 29/125; B65H 29/12; B65H 5/025; B65H 5/06
USPC ..... 271/272, 273, 274, 314; 347/104
See application file for complete search history.

(56) References Cited

U.S. PATENT DOCUMENTS 6,817,611 B2 * 11/2004 DiRamio ..... 271/273
7,530,568 B2 * 5/2009 Uchida et al. ..... 271/273
(Continued)

FOREIGN PATENT DOCUMENTS

JP 10-181939 A 7/1998
JP 2012-71563 4/2012
JP 2013-230921 A 11/2013

OTHER PUBLICATIONS

Office Action issued in corresponding Japanese Patent Application No. 2014-056201, Jan. 17, 2017.

*Primary Examiner* — Thomas Morrison
(74) *Attorney, Agent, or Firm* — Merchant & Gould P.C.

(57) ABSTRACT

A conveyor includes: a conveyor roller unit including a conveyor roller; a transmission mechanism; a driven roller unit including a driven roller; a supporting member which supports the conveyor roller unit and the driven roller unit to allow the conveyor roller unit and the driven roller unit to take a conveyance position or a retracted position; and a movable member which is movable between a first position where the conveyor roller and the driven roller take the conveyance position and a second position where the conveyor roller and the driven roller take the refracted position. The movable member moves from the second position to the first position when the conveyor roller in the second position rotates in one direction.

13 Claims, 12 Drawing Sheets

(51) Int. Cl.

| | |
|---|---|
| ***B65H 5/06*** | (2006.01) |
| ***B65H 3/06*** | (2006.01) |
| ***B65H 9/00*** | (2006.01) |

(52) U.S. Cl.

CPC ..... *B65H 2404/1441* (2013.01); *B65H 2404/6111* (2013.01); *B65H 2405/3322* (2013.01); *B65H 2511/20* (2013.01); *B65H 2511/224* (2013.01); *B65H 2601/11* (2013.01)

(56) References Cited

U.S. PATENT DOCUMENTS

| | | | | |
|---|---|---|---|---|
| 2011/0115146 | A1* | 5/2011 | Shimomura et al. | 271/10.13 |
| 2013/0293656 | A1 | 11/2013 | Anami | |
| 2014/0232800 | A1* | 8/2014 | Sano et al. | 347/104 |
| 2015/0090561 | A1* | 4/2015 | Mimoto et al. | 198/780 |

* cited by examiner

CONVEYOR

CROSS REFERENCE TO RELATED APPLICATION

The present application claims priority from Japanese Patent Application No. 2014-056201, which was filed on Mar. 19, 2014, the disclosure of which is herein incorporated by reference in its entirety.

BACKGROUND OF THE INVENTION

1. Field of the Invention

The present invention relates to a conveyor for conveying sheets.

2. Description of Related Art

A known printer includes a first roller and a second roller which convey paper while holding the same, a roller supporting member which is switchable between a first state in which the second roller contacts with the first roller and a second state in which the second roller is separated from the first roller, and a slider configured to switch the state of the roller supporting member. In this printer, when paper jam occurs, the switching to the second state in which the second roller is separated from the first roller is performed in response to a user's operation of pulling out a slider. This makes it possible to easily remove the paper sandwiched between the first roller and the second roller.

In the printer above, after the removal of the jammed paper, the user operates the slider to switch to the first state in which the second roller contacts with the first roller. For this reason, if the user forgets to operate the slider and instructs paper conveyance without operating the slider, paper is not properly conveyed because the first roller and the second roller are still in the second state.

SUMMARY OF THE INVENTION

An object of the present invention according to an aspect of the invention is to provide a conveyor which is capable of properly conveying sheets.

A conveyor of the present invention includes: a drive motor; a conveyor roller unit including a conveyor roller; a transmission mechanism configured to transmit a driving force from the drive motor to the conveyor roller; a driven roller unit including a driven roller which opposes the conveyor roller and is configured to convey a sheet while holding the sheet with the conveyor roller; a supporting member which supports the conveyor roller unit and the driven roller unit to allow the conveyor roller unit and the driven roller unit to take a conveyance position where the conveyor roller and the driven roller convey the sheet while holding the sheet or a retracted position where a holding force by which the sheet is held by the conveyor roller and the driven roller is smaller than a holding force in the conveyance position; and a movable member which is engaged with at least the conveyor roller unit among the conveyor roller unit and the driven roller unit and is movable between a first position where the conveyor roller and the driven roller take the conveyance position and a second position where the conveyor roller and the driven roller take the retracted position, the movable member moving from the second position to the first position when the conveyor roller in the second position rotates in one direction.

Figure 8A:
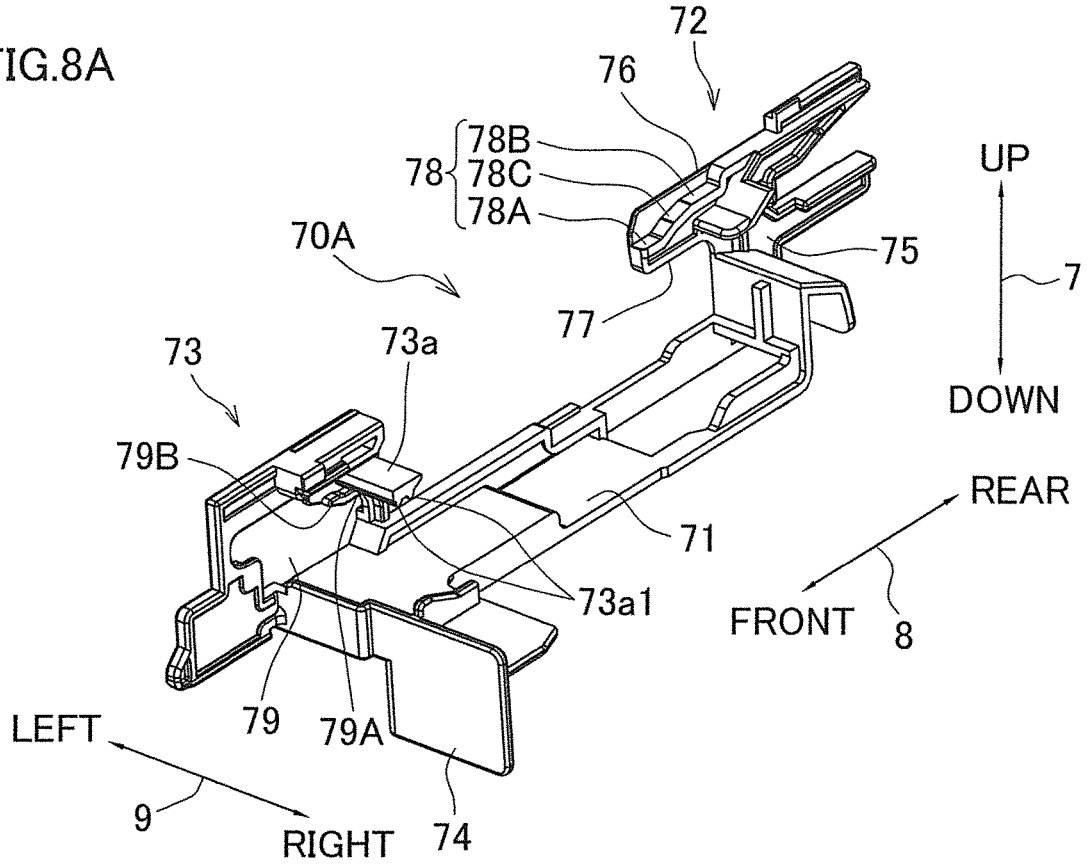
Figure 8B:
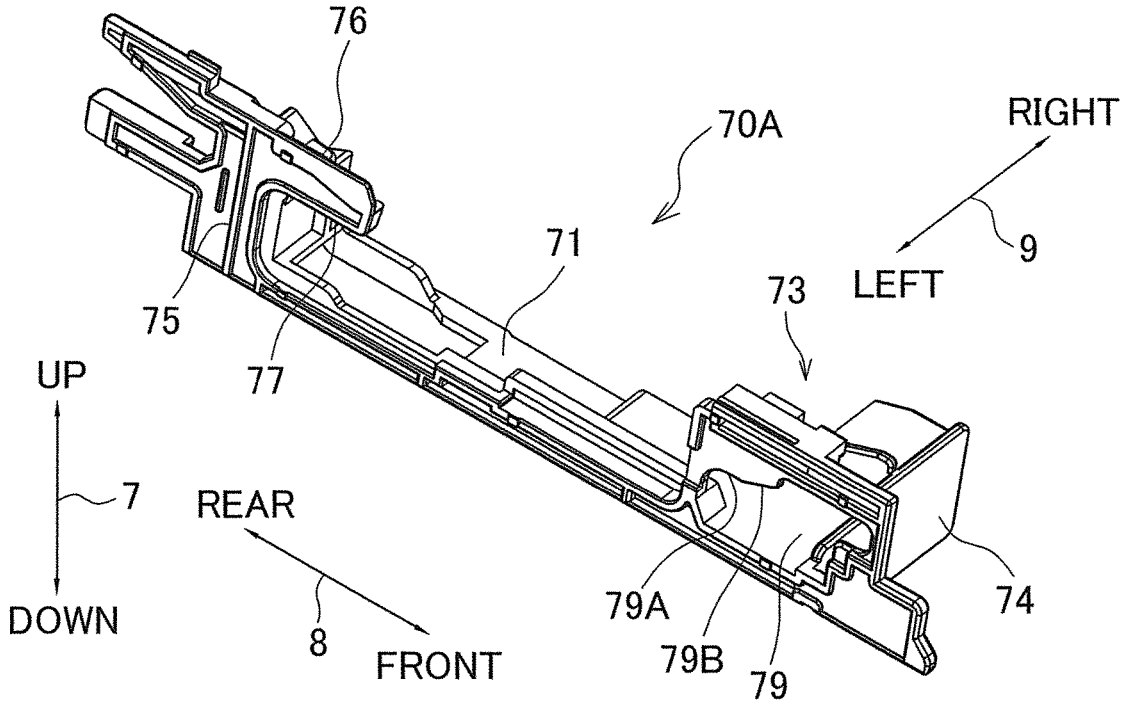

Each of FIGS. 8A and 8B is an oblique perspective of the release rod.

Figure 9:
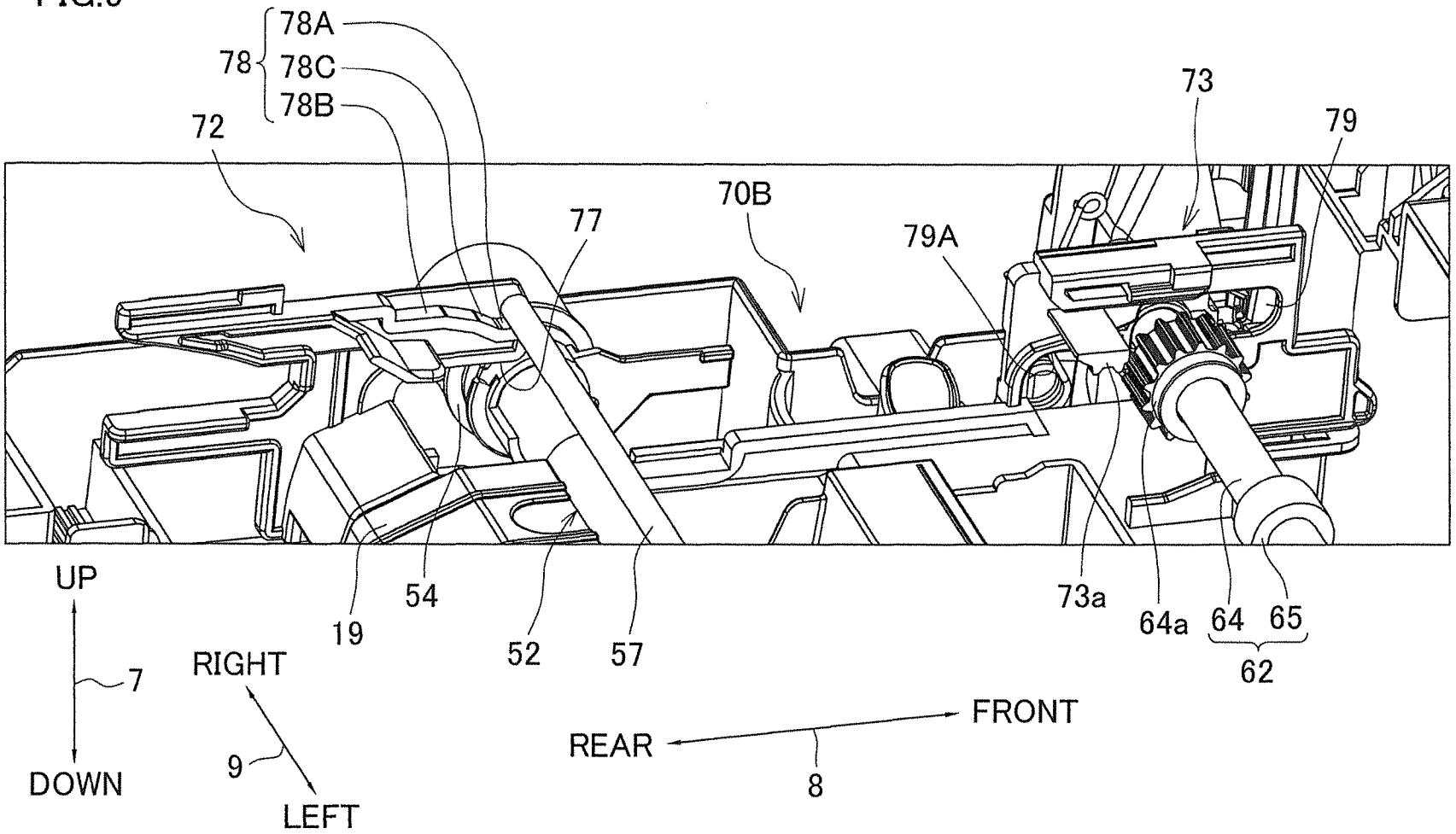

FIG. 9 is a partial oblique perspective showing the states of the registration roller pair and the discharge roller pair when the release rod is in a first position.

Figure 10:
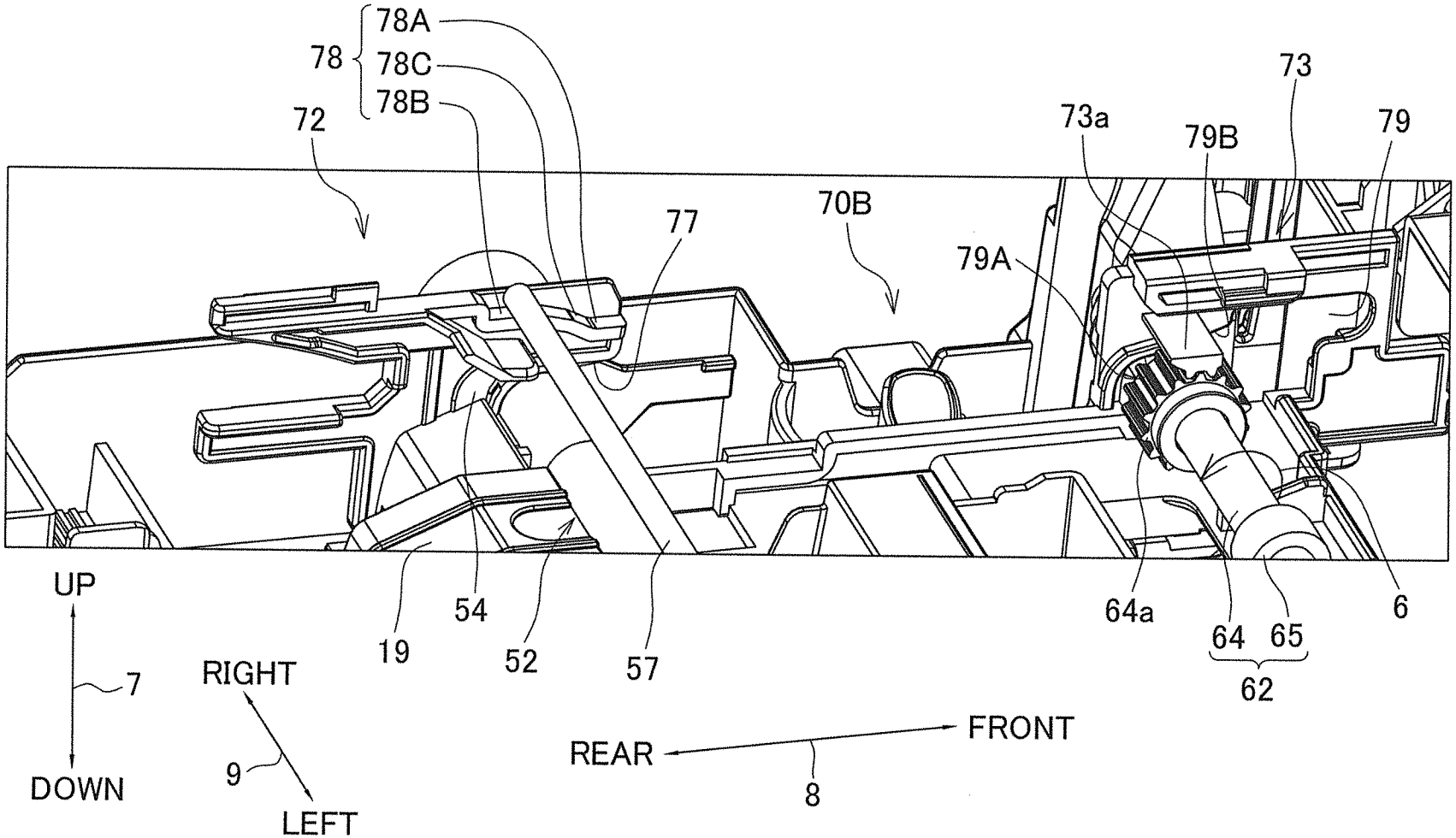

FIG. 10 is a partial oblique perspective showing the states of the registration roller pair and the discharge roller pair when the release rod is in a second position.

Figure 11A:
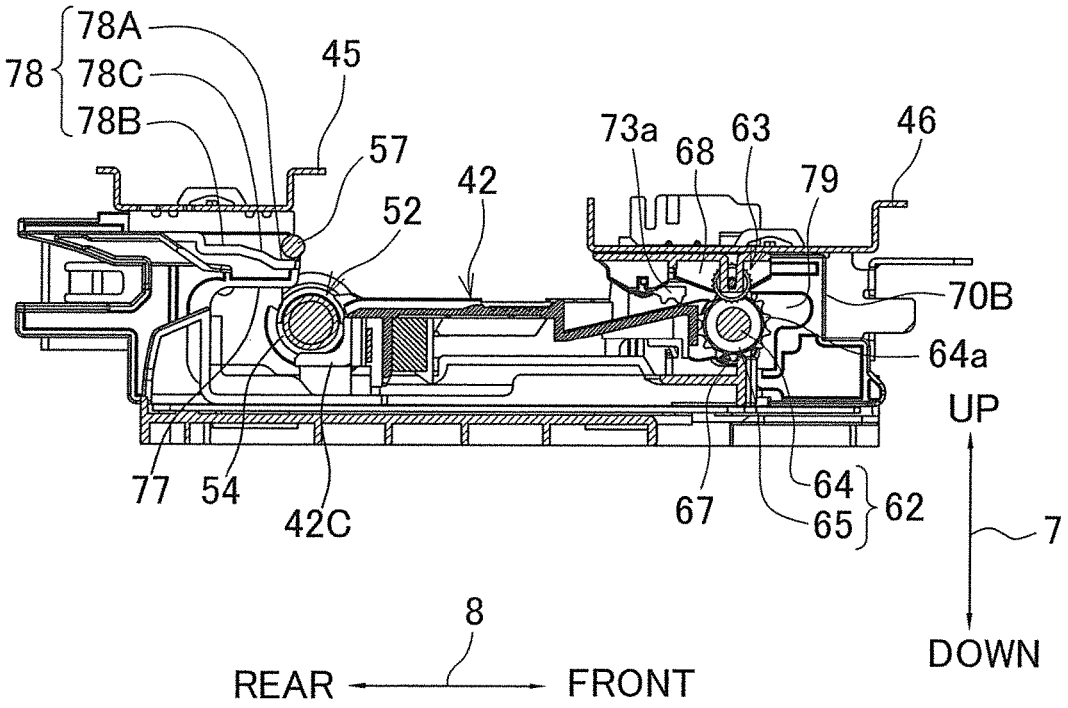
Figure 11B:
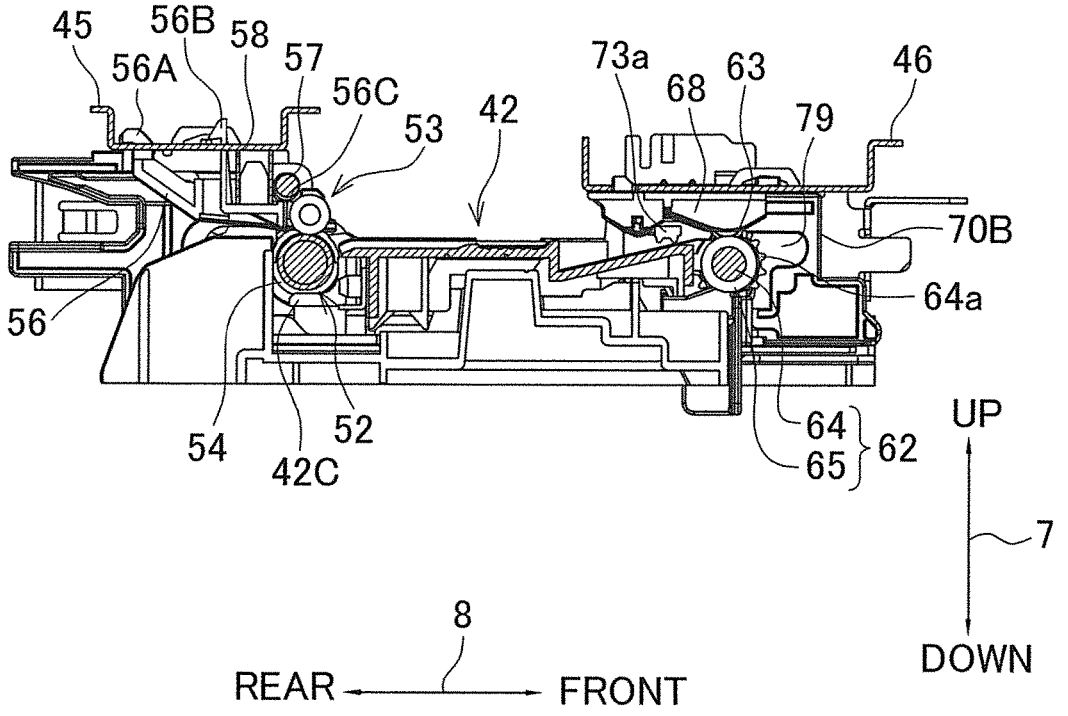

Each of FIGS. 11A and 11B is a cross section showing the states of the registration roller pair, the discharge roller pair, and the platen when the release rod is in the first position.

Figure 12A:
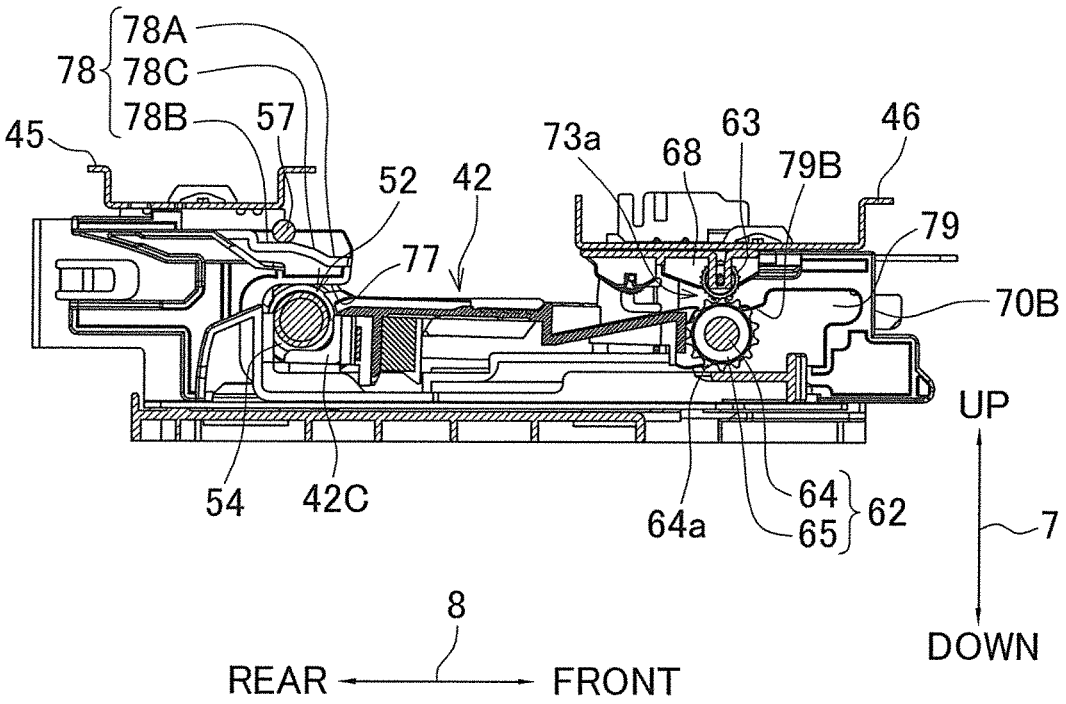
Figure 12B:
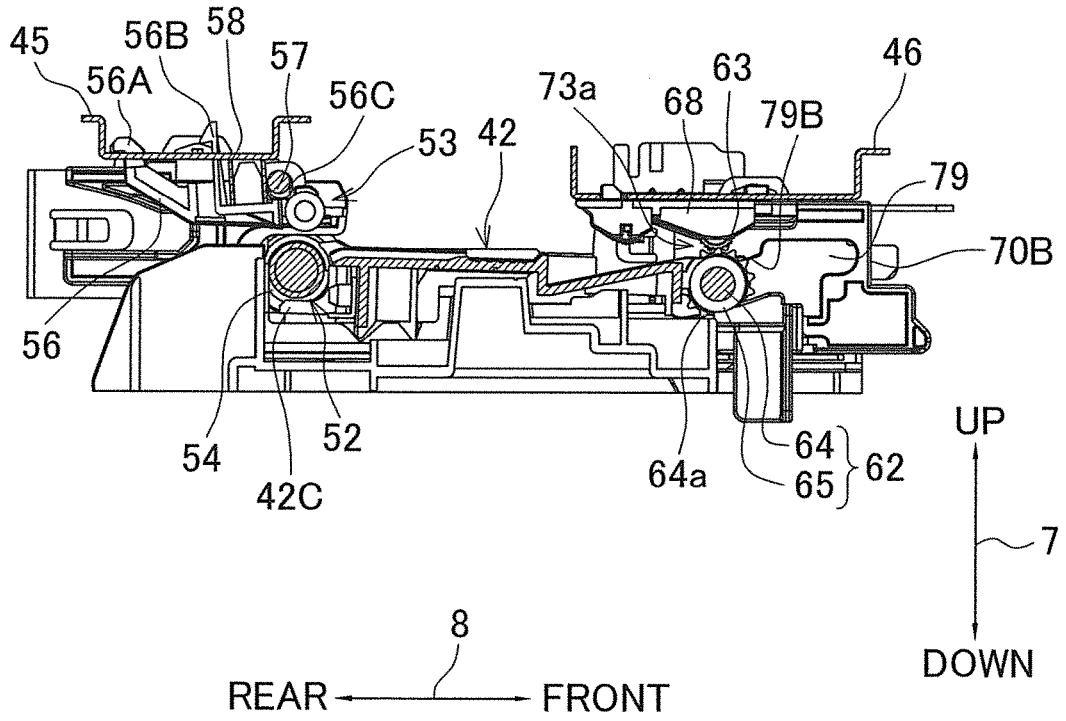

Each of FIGS. 12A and 12B is a cross section showing the states of the registration roller pair, the discharge roller pair, and the platen when the release rod is in the second position.

DESCRIPTION OF THE PREFERRED EMBODIMENTS

The following will describe a preferred embodiment of the present invention suitably with reference to figures. In the descriptions below, an up-down direction 7 is defined with reference to a state (shown in FIG. 2) in which a multifunction machine 10 employing a conveyor 1 of an embodiment of the present invention is disposed to be readily usable, a front-rear direction 8 is defined on the assumption that the side on which an opening 13 is provided is the front side (front), and a left-right direction 9 is defined on the assumption that the multifunction machine 10 is viewed from the front side (i.e., the front of the machine 10 is viewed).

[Overall Structure of Multifunction Machine 10]

Figure 1:
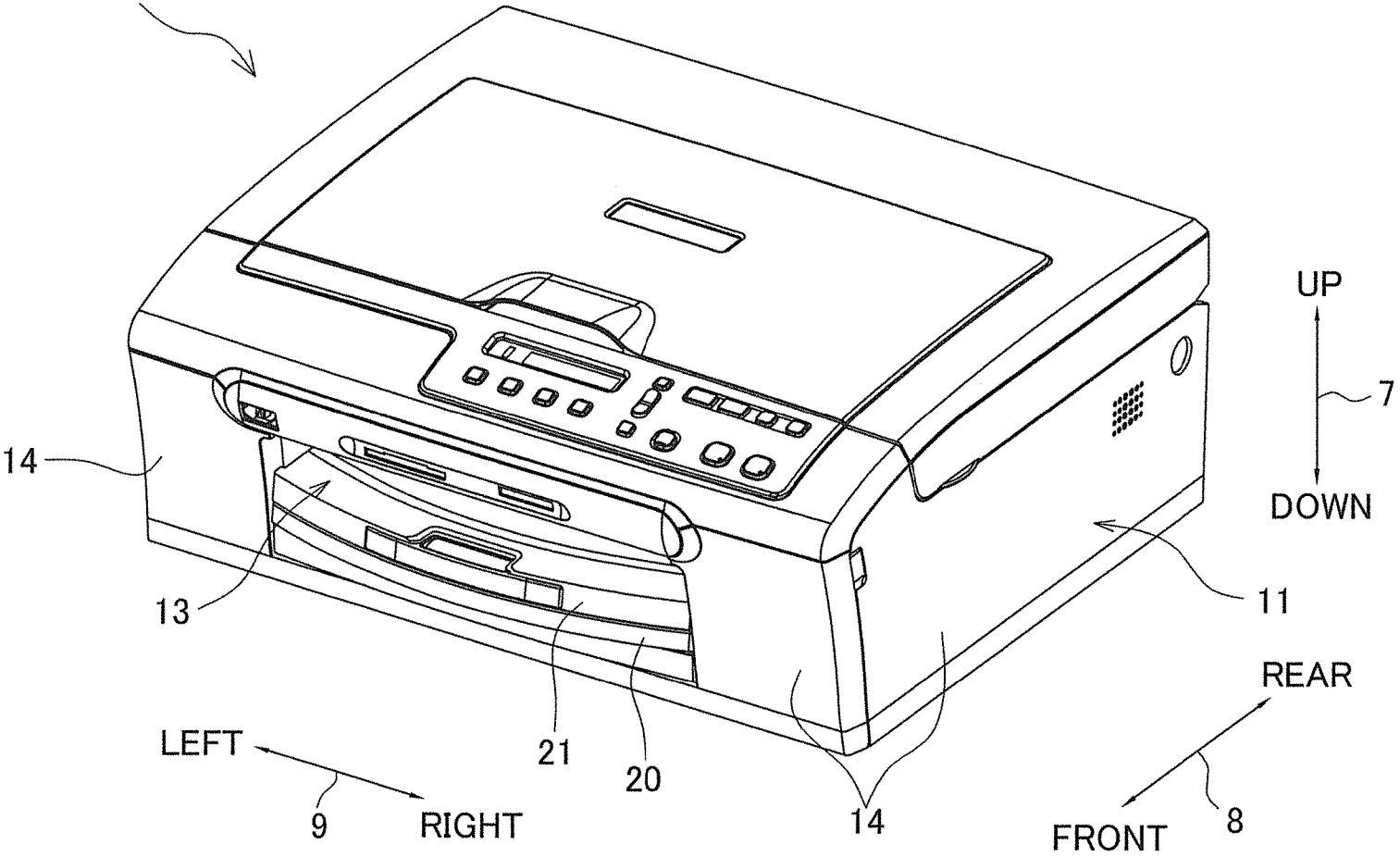
FIG. 1 is an oblique perspective of a multifunction machine employing a conveyor of an embodiment of the present invention.
Figure 2:
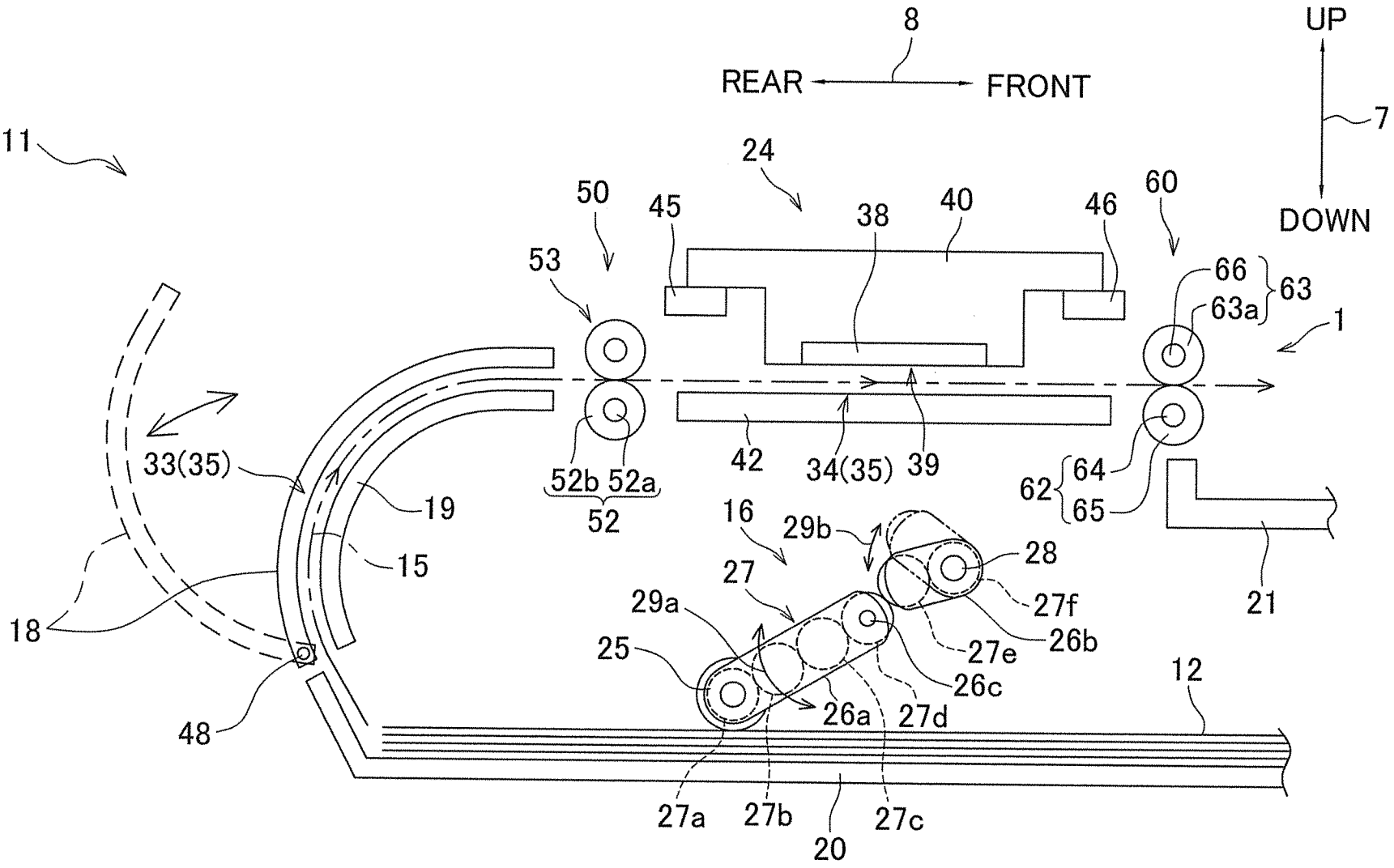
FIG. 2 is a schematic profile showing the internal structure of the printer unit shown in FIG. 1.

As shown in FIG. 1, the multifunction machine 10 is substantially rectangular parallelepiped in shape and is provided with a printer unit 11 at a lower part. The multifunction machine 10 has functions such as a facsimile function and a printing function. As the printing function, the multifunction machine 10 has a function of recording an image on one side of paper 12 (sheet: see FIG. 2) by inkjet. The multifunction machine 10 may record images on both sides of the sheet 12. As shown in FIG. 2, the printer unit 11 includes a conveyor 1 which is configured to convey the sheet 12 inside the multifunction machine 10. The conveyor 1 includes later-described members such as a controller 180, a conveyance motor 2 (corresponding to a drive motor), a transmission mechanism 3, a feeding unit 16, a platen 42, a registration roller pair 50, a discharge roller pair 60, side frames 120 and 130, and release rods 70A and 70B.

Through the front surface of the printer unit 11 is formed an opening 13 (see FIG. 1). The printer unit 11 is provided with a feeding tray 20 which is able to store sheets 12 with different sizes and is detachable and attachable through the opening 13 in the front-rear direction. Above the feeding tray 20, a discharge tray 21 is positioned. The discharge tray 21 is moved together with the feeding tray 20. The discharge tray 21 supports a sheet 12 on which an image has been recorded by a later-described recording unit 24 and has been discharged by the discharge roller pair 60.

The printer unit 11 includes a base 100 (see FIG. 5) and an outer cover 14 covering the base 100 from above. The base 100 supports members such as the feeding unit 16, the registration roller pair 50, the recording unit 24, the discharge roller pair 60, the platen 42, and the side frames 120 and 130, and is covered with the outer cover 14.

The feeding unit 16 picks up a sheet 12 from the feeding tray 20 and feeds the sheet 12 to a conveyance passage 35. After correcting the skew of the sheet 12 having been fed to the conveyance passage 35 by the feeding unit 16, the registration roller pair 50 conveys the sheet 12 to the downstream in a conveyance direction 15. The platen 42 supports, from below, the sheet 12 conveyed by the registration roller pair 50. The recording unit 24 records an image on the sheet 12 supported by the platen 42, by ejecting ink droplets. The discharge roller pair 60 discharges, to the discharge tray 21, the sheet 12 on which the image has been recorded by the recording unit 24.

[Conveyance Passage 35]

As shown in FIG. 2, the conveyance passage 35 extends from a rear end portion of the feeding tray 20. The conveyance passage 35 includes a curved conveyance passage 33 and a linear conveyance passage 34. The curved conveyance passage 33 curves and extends in such a way that the rear side of the printer unit 11 is the outer side of the curve whereas the front side of the printer unit 11 is the inner side of the curve. The linear conveyance passage 34 extends in the front-rear direction 8. The sheet 12 supported by the feeding tray 20 is conveyed upward on the curved conveyance passage 33 to make a U-turn, and is then conveyed forward in the front-rear direction 8 on the linear conveyance passage 34 and reaches the recording unit 24. The sheet 12 on which the image has been formed by the recording unit 24 is conveyed further forward in the front-rear direction 8 on the linear conveyance passage 34, and is then discharged to the discharge tray 21. In other words, the sheet 12 is conveyed in the conveyance direction 15 indicated by dashed arrows shown in FIG. 2.

The curved conveyance passage 33 is constituted by an outer guide member 18 and an inner guide member 19 which oppose each other over a predetermined gap. The outer guide member 18 forms the outer side of the curve of the curved conveyance passage 33. The inner guide member 19 forms the inner side of the curve of the curved conveyance passage 33. The linear conveyance passage 34 is constituted by the recording unit 24 and the platen 42 which oppose each other over a predetermined gap.

The outer guide member 18 is rotatably supported by the later-described base 100. At the respective ends in a lower end portion of the outer guide member 18 in the left-right direction 9, shafts 48 are formed to extend in the left-right direction 9. The shafts 48 are inserted into unillustrated holes formed through the base 100. This allows the outer guide member 18 to rotate between a covering position (indicated by the full lines in FIG. 2) where the curved conveyance passage 33 is covered and an exposing position (indicated by broken lines in FIG. 2) where the curved conveyance passage 33 is exposed.

In the covering position, the outer guide member 18 forms the curved conveyance passage 33 of the conveyance passage 35 with the inner guide member 19 opposing the outer guide member 18. In the meanwhile, when the outer guide member 18 is in the exposing position, the outer surface of the inner guide member 19 is exposed to the outside of the printer unit 11. In other words, the outer guide member 18 in the exposing position causes the curved conveyance passage 33 of the conveyance passage 35 to be exposed to the outside. This allows the user of the multifunction machine 10 to remove a sheet 12 jammed in the curved conveyance passage 33 (so-called jamming treatment).

[Feeding Unit 16]

As shown in FIG. 2, the feeding unit 16 is provided, in the printer unit 11, above the feeding tray 20 and below the recording unit 24. The feeding unit 16 includes a feed roller 25, a first feed arm 26*a*, a second feed arm 26*b*, and a drive transmission mechanism 27. The feed roller 25 pivots on the leading end of the first feed arm 26. The first feed arm 26*a* is arranged to be rotatable in the directions indicated by the arrows 29*a*, about a supporting shaft 26*c* provided at the proximal end portion. With this arrangement, the feed roller 25 is able to contact with and to be separated from the feeding tray 20 or a sheet 12 supported by the feeding tray 20.

The second feed arm 26*b* is arranged to be rotatable in the directions indicated by the arrows 29*b*, about a supporting shaft 28 provided at the proximal end portion. The drive transmission mechanism 27 includes four gears 27*a* to 27*d* which are attached to the first feed arm 26*a* and are engaged with one another and two gears 27*e* and 27*f* which are attached to the second feed arm 26*b* and are engaged with each other. The drive transmission mechanism 27 transmits a driving force of the conveyance motor 2 (see FIG. 3) to the feed roller 25. The gear 27*a* transmits the rotational force transmitted from the gear 27*b* to the feed roller 25. The gear 27*f* rotates in the same direction as the supporting shaft 28 in accordance with the rotation of the supporting shaft 28, so as to transmit the rotational force to the gear 27*e*. As described below, the supporting shaft 28 rotates clockwise as shown in FIG. 2 when the conveyance motor 2 drives forward, and rotates counterclockwise as shown in FIG. 2 when the conveyance motor 2 drives backward.

When the conveyance motor 2 drives forward, the second feed arm 26*b* is rotated in accordance with the rotation of the supporting shaft 28 to a position indicated by a two-dot chain line in FIG. 2, where the gear 27*e* is separated from the gear 27*d*. In the meanwhile, when the conveyance motor 2 drives backward, the second feed arm 26*b* is rotated in accordance with the rotation of the supporting shaft 28 to a position indicated by a full line in FIG. 2, where the gear 27*e* is engaged with the gear 27*d*. As such, the second feed arm 26*b* is positioned at a non-transmission position where the drive transmission mechanism 27 cannot transmit the driving force of the conveyance motor 2 to the feed roller 25 when the conveyance motor 2 drives forward, whereas the second feed arm 26*b* is positioned at a transmission position where the drive transmission mechanism 27 can transmit the driving force of the conveyance motor 2 to the feed roller 25, when the conveyance motor 2 drives backward.

[Registration Roller Pair 50]

As shown in FIG. 2, the registration roller pair 50 is constituted by a registration roller 52 and pinch rollers 53, and is positioned on the upstream of the recording unit 24 in the conveyance direction 15. The registration roller 52 in the present embodiment includes a shaft member 52*a* and a roller 52*b*. The roller 52*b* is formed by ceramic-coating the outer circumferential surface of the shaft member 52*a*. In the present embodiment, a metal cylindrical shaft (hollow shaft) is employed as the shaft member 52*a*. The specific arrangement of the registration roller 52, however, is not limited to this. The registration roller 52 may be formed by externally fitting the roller 52*b* to the shaft member 52*a*, or a solid shaft may be employed as the shaft member 52*a*. The registration roller 52 of the present embodiment is positioned below the pinch rollers 53 and contacts with the lower surface of the sheet 12 guided from the curved conveyance passage 33 to the linear conveyance passage 34. The registration roller 52 is rotated as it receives a driving force from the conveyance motor 2 via the transmission mechanism 3 (registration roller gear 150).

In the meanwhile, each pinch roller 53 is positioned to oppose the registration roller 52 and contacts with the upper surface of the sheet 12. The pinch rollers 53 are rotated in accordance with the rotation of the registration roller 52. The registration roller 52 and the pinch rollers 53 cooperate to hold the sheet 12 in the up-down direction 7 and convey the sheet 12 in the conveyance direction 15.

[Discharge Roller Pair 60]

As shown in FIG. 2, the discharge roller pair 60 is constituted by a discharge roller 62 (corresponding to a conveyor roller and a conveyor roller unit) and spur rollers 63 (corresponding a driven roller and a driven roller unit), and is provided on the downstream in the conveyance direction 15 of the recording unit 24. The discharge roller 62 in the present embodiment is positioned below the spur rollers 63 and contacts with the lower surface of the sheet 12 conveyed on the linear conveyance passage 34. The discharge roller 62 is constituted by a shaft member 64 which rotates as it receives a driving force from the conveyance motor 2 and a roller 65 which is externally fitted to the shaft member 64 and rotates together with the shaft member 64. In the meanwhile, the spur rollers 63 are positioned to oppose the discharge roller 62 and contacts with the upper surface of the sheet 12. Each spur roller 63 is constituted by a shaft member 66 and a spur 63*a* which is externally fitted to the shaft member 66 and is rotated in accordance with the rotation of the discharge roller 62. The discharge roller 62 and the spur rollers 63 cooperate and hold the sheet 12 in the up-down direction 7, and convey the sheet 12 in the conveyance direction 15. As a result, the sheet 12 is conveyed from the discharge roller pair 60 toward the opening 13 which is on the downstream in the conveyance direction 15, and is discharged to the discharge tray 21 which is inserted into a later-described tray housing space 107.

[Transmission Mechanism 3]

Figure 3:
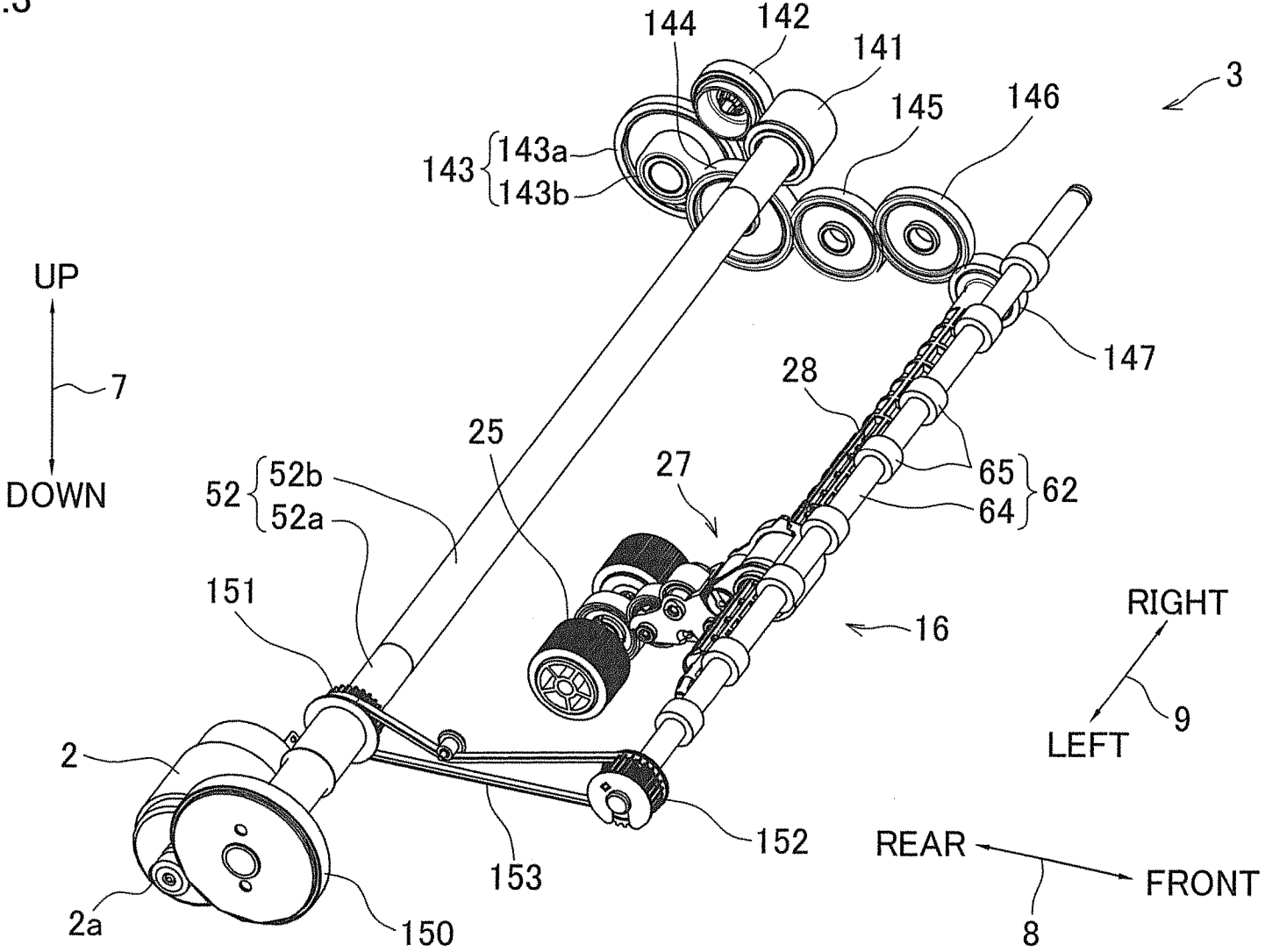
FIG. 3 is an oblique perspective showing a transmission mechanism.

As shown in FIG. 3, the transmission mechanism 3 includes a registration roller gear 150, two timing pulleys 151 and 152, a timing belt 153, and seven gears 141 to 147. The registration roller gear 150 is fixed to the left end portion of the shaft member 52*a* while being engaged with the gear 2*a* of the conveyance motor 2. With this, the registration roller 52 rotates forward as it receives a driving force from the forward-driving conveyance motor 2. The forward rotation of the registration roller 52 indicates the rotation with which the sheet 12 is conveyed in the conveyance direction 15. That is to say, in FIG. 2, the forward rotation of the registration roller 52 indicates clockwise rotation, whereas the forward rotation of the pinch rollers 53 indicates counterclockwise rotation. In the meanwhile, the registration roller 52 rotates backward as it receives a driving force from the backward-driving conveyance motor 2. The backward rotation of the registration roller 52 indicates the rotation with which the sheet 12 is conveyed in the direction opposite to the conveyance direction 15. That is to say, in FIG. 2, the backward rotation of the registration roller 52 is counterclockwise rotation, whereas the backward rotation of the pinch rollers 53 indicates clockwise rotation.

The timing pulley 151 is externally fitted to around the left end portion of the shaft member 52*a* to rotate together with the shaft member 52*a*. The timing pulley 152 is externally fitted to the left end portion of the shaft member 64 to rotate together with the shaft member 64. The timing belt 153 is an endless belt stretched around these timing pulleys 151 and 152. With this arrangement, the discharge roller 62 rotates in the same direction as the registration roller 52, as the registration roller 52 rotates. To be more specific, the discharge roller 62 rotates forward as it receives a driving force from the forward-driving conveyance motor 2. The forward rotation of the discharge roller 62 is rotation by which the sheet 12 is conveyed in the conveyance direction 15. That is to say, in FIG. 2, the forward rotation of the discharge roller 62 is clockwise rotation, whereas the forward rotation of the spur roller 63 is counterclockwise rotation. In the meanwhile, the discharge roller 62 rotates backward as it receives a driving force from the backward-rotating conveyance motor 2. The backward rotation of the discharge roller 62 indicates the rotation with which the sheet 12 is conveyed in the direction opposite to the conveyance direction 15. That is to say, in FIG. 2, the backward rotation of the discharge roller 62 is counterclockwise rotation, whereas the backward rotation of the spur roller 63 is clockwise rotation.

The gear 141 is externally fitted to the right end portion of the shaft member 52*a* to rotate together with the shaft member 52*a*. The five gears 142 to 146 are rotatably supported by the base 100. The gear 142 is positioned to be engaged with the gear 141. The gear 143 includes a large-diameter portion 143*a* and a small-diameter portion 143*b*, and the large-diameter portion 143*a* is positioned to be engaged with the gear 142. The gear 144 is positioned to be engaged with the small-diameter portion 143*b* and the gear 145. The gear 146 is positioned to be engaged with the gear 145 and the gear 147. The gear 147 is fixed to the right end portion of the supporting shaft 28 to rotate in the same direction as the supporting shaft 28. The supporting shaft 28 is rotatably supported by the base 100.

With this arrangement, when the conveyance motor 2 drives forward, the supporting shaft 28 rotates clockwise in FIG. 2 as it receives a driving force from the conveyance motor 2 via the registration roller gear 150, the registration roller 52, and the seven gears 141 to 147. As a result, the second feed arm 26*b* is positioned at the non-transmission position. In the meanwhile, when the conveyance motor 2 drives backward, the supporting shaft 28 rotates counterclockwise in FIG. 2 as it receives a driving force from the conveyance motor 2 via the registration roller gear 150, the registration roller 52, and the seven gears 141 to 147. As a result, the second feed arm 26*b* is positioned at the transmission position and the feed roller 25 rotates clockwise in FIG. 2. As such, the sheet 12 is fed to the conveyance passage 35 by the feed roller 25. When the feed roller 25 conveys the sheet 12 toward the registration roller pair 50, the registration roller pair 50 rotates to convey the sheet 12 in the direction opposite to the conveyance direction 15. With this, skew correction of the leading end of the sheet 12 conveyed by the feed roller 25 is performed by the registration roller pair 50. Thereafter, as the conveyance motor 2 drives forward, the sheet 12 after the skew correction by the registration roller pair 50 is conveyed in the conveyance direction 15 by the registration roller pair 50. At this stage, because the second feed arm 26*b* is in the non-transmission position, the driving force of the conveyance motor 2 is not transmitted to the feed roller 25. Furthermore, because the feed roller 25 is in a freely rotatable state, the sheet 12 is correctly conveyed even if the sheet 12 conveyed by the registration roller pair 50 contacts with the feed roller 25.

[Platen 42]

As shown in FIG. 2, the platen 42 is provided below the linear conveyance passage 34 and between the registration roller pair 50 and the discharge roller pair 60. The platen 42 is positioned to oppose the recording unit 24 in the up-down direction 7 and supports from below the sheet 12 conveyed on the linear conveyance passage 34.

[Recording Unit 24]

As shown in FIG. 2, the recording unit 24 is positioned above the linear conveyance passage 34 to oppose the platen 42 in the up-down direction 7. The recording unit 24 includes a carriage 40, a record head 38, and a drive mechanism 40*a* (see FIG. 4). The carriage 40 is supported by two guide rails 45 and 46. The two guide rails 45 and 46 are positioned to be separated from each other in the front-rear direction 8, and each of which extends in the left-right direction 9. The carriage 40 is provided to contact with the two guide rails 45 and 46. Furthermore, the drive mechanism 40*a* includes a carriage drive motor 40M, and reciprocates, under the control of the controller 180, the carriage 40 along the two guide rails 45 and 46 in the left-right direction 9 which is the main scanning direction. The record head 38 is mounted on the carriage 40. The record head 38 ejects ink supplied from an unillustrated ink cartridge, through nozzles 39 in the lower surface of the record head 38. Therefore, as ink droplets are ejected from the nozzles 39 of the record head 38 toward the platen 42 while the carriage 40 is moving in the left-right direction 9, an image is recorded on the upper surface of the sheet 12 supported by the platen 42.

[Controller 180]

Figure 4:
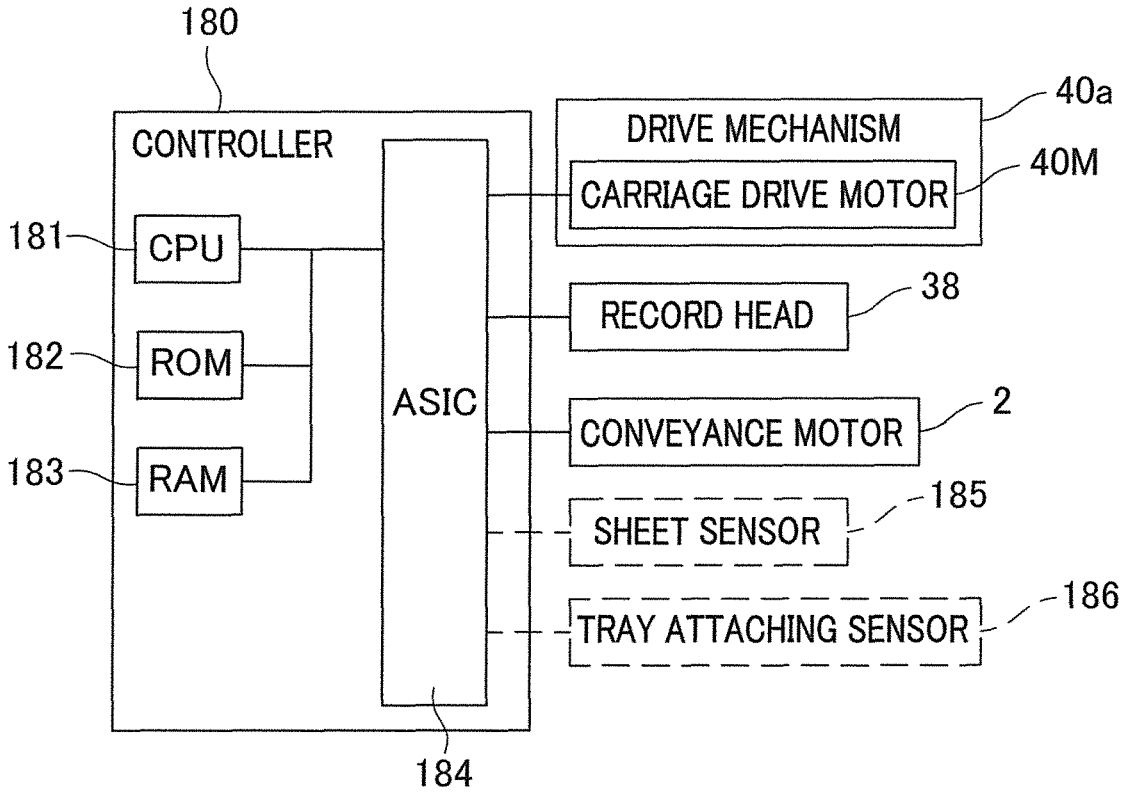
FIG. 4 is a block diagram of a controller.

As shown in FIG. 4, the controller 180 includes members such as a CPU (Central Processing Unit) 181, a ROM (Read Only Memory) 182, a RAM (Random Access Memory) 183, and an ASIC (Application Specific Integrated Circuit) 184, and these members cooperate to control the operations of the members such as the carriage drive motor 40M, the record head 38, and the conveyance motor 2. For example, based on a printing command sent from an external apparatus such as a PC, the controller 180 controls the record head 38, the carriage drive motor 40M, the conveyance motor 2 or the like to print an image or the like on a sheet 12. While FIG. 4 shows one CPU 181 and one ASIC 184, the controller 180 may include the CPU 181 only and this single CPU 181 may integrally perform necessary processes, or the controller 180 may include plural CPUs 181 and these CPUs 181 may perform necessary processes in a distributed manner. Alternatively, the controller 180 may include the ASIC 184 only and this single ASIC 184 may integrally perform necessary processes, or the controller 180 may include plural ASICs 184 and these ASICs 184 may perform necessary processes in a distributed manner. While the controller 180 of the present embodiment controls the operations of the carriage drive motor 40M, the record head 38, and the conveyance motor 2, the controller 180 may control only the operation of the conveyance motor 2. In this case, the printer unit 11 includes another controller which controls the operations of the record head 38 and the carriage drive motor 40M.

[Base 100]

Figure 5:
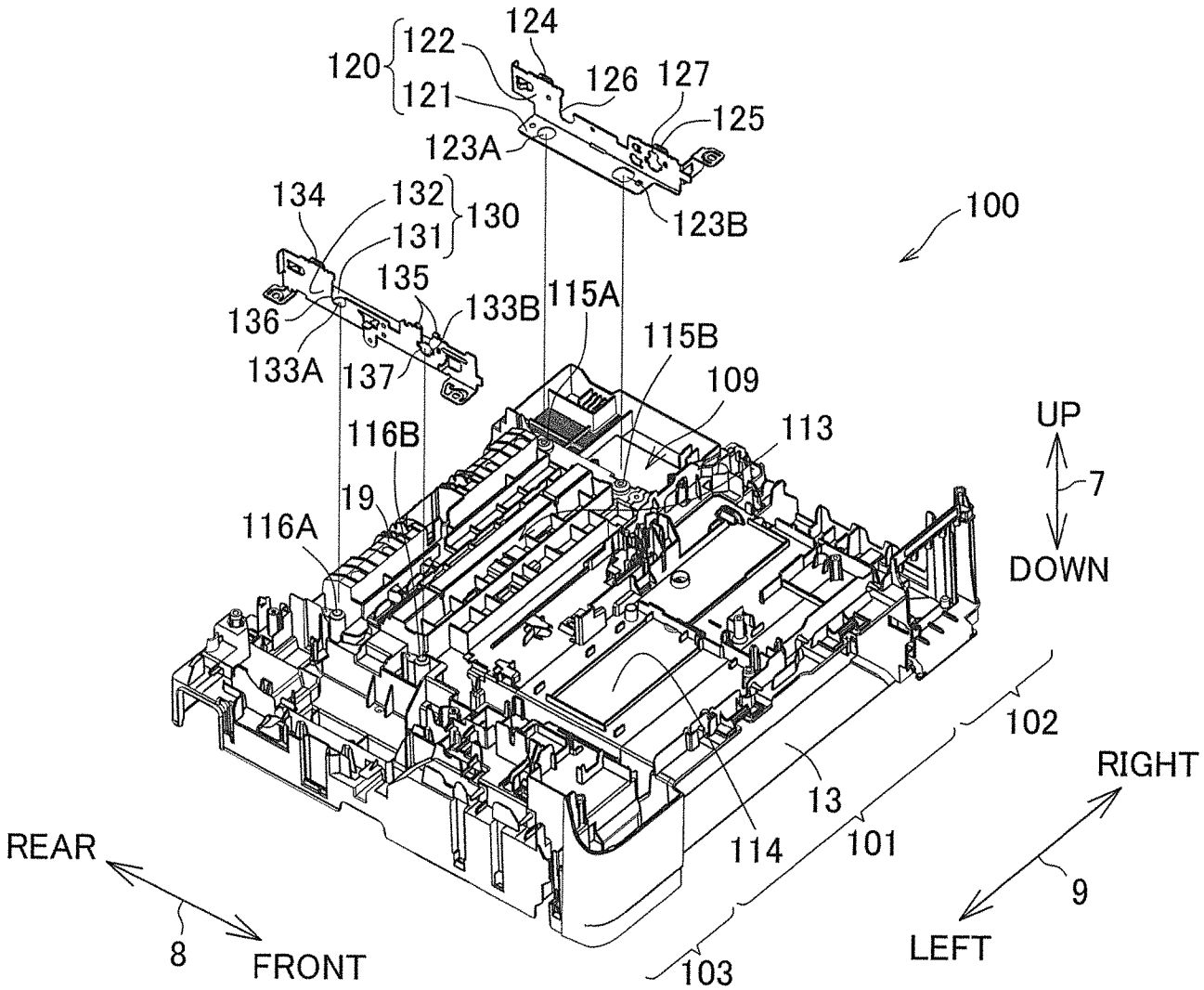
FIG. 5 is an exploded perspective of a base and side frames.

As shown in FIG. 5, the base 100 includes a center base 101 positioned at a central part in the left-right direction 9 and side bases 102 and 103 which neighbor the center base 101 in the left-right direction 9. The side base 102 is adjacently to the right of the center base 101. The side base 103 is adjacently to the left of the center base 101. The center base 101 is provided between the side bases 102 and 103 in the left-right direction 9. The base 100 of the present embodiment is formed by integral molding of a resin material.

The center base 101 includes a main wall 113 which is on the rear side in the front-rear direction 8 and a main wall 114 which is on the front side in the front-rear direction 8. The main walls 113 and 114 are provided to extend in the front-rear direction 8 and the left-right direction 9, between the side bases 102 and 103. The main walls 113 and 114 are separated from each other in the front-rear direction 8. The main wall 113 supports members such as the feeding unit 16, the recording unit 24, the registration roller pair 50, the discharge roller pair 60, and the platen 42. The main wall 114 supports members such as an unillustrated control substrate constituting the controller 180 which is configured to control the operation of the multifunction machine 10.

Figure 7:
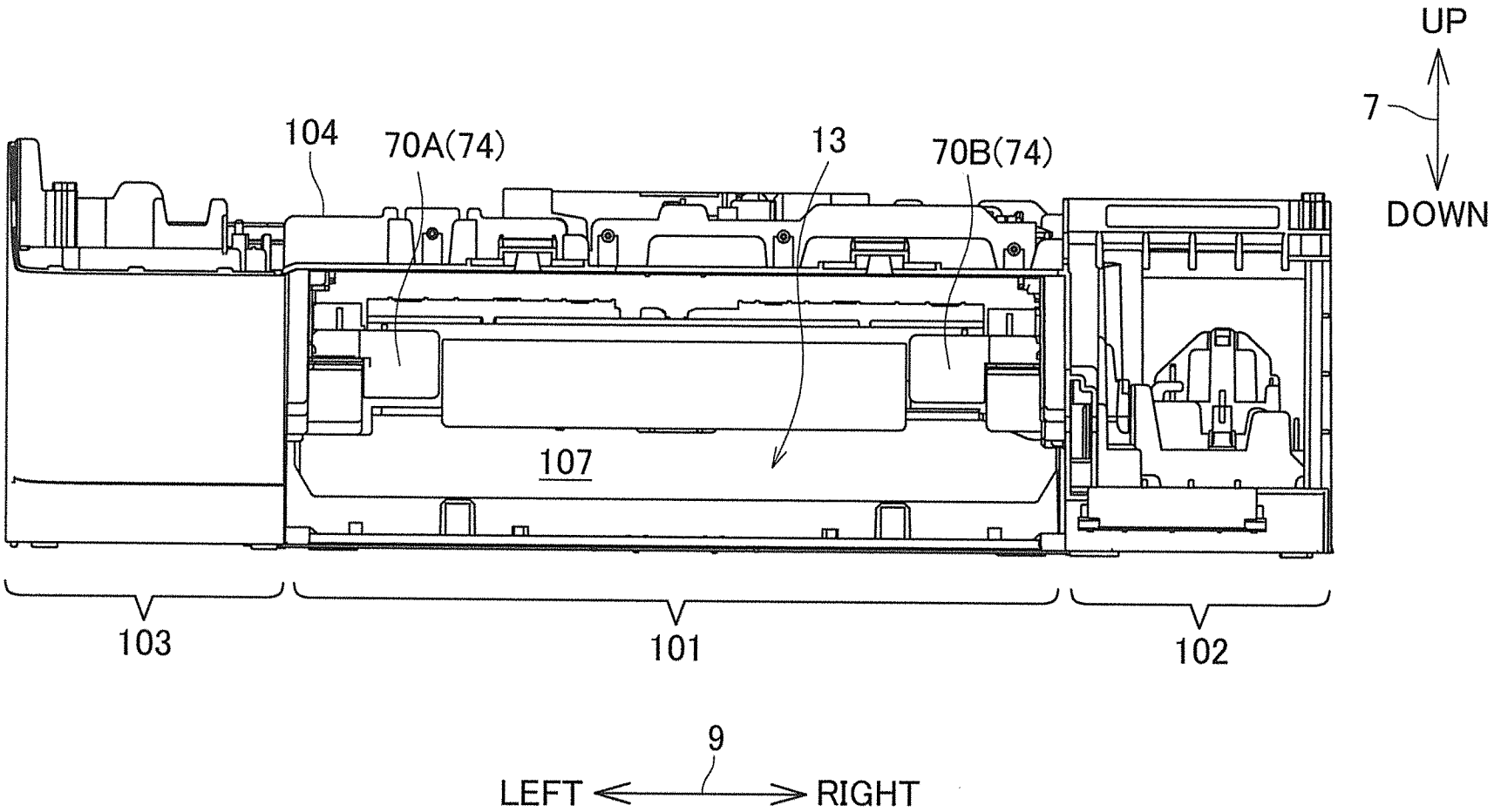
FIG. 7 is a plan view of the multifunction machine when it is viewed from the front side.

As shown in FIG. 7, the center base 101 is provided with the tray housing space 107 (see FIG. 7) housing the feeding tray 20 and the discharge tray 21. As shown in FIG. 7, the tray housing space 107 is provided below the main walls 113 and 114 of the center base 101 in the up-down direction 7. The tray housing space 107 is provided across the almost entirety of the base 100 in the front-rear direction 8. Furthermore, the tray housing space 107 is provided at a position corresponding to the center base 101 in the left-right direction 9 (i.e., at a central part of the base 100).

As shown in FIG. 5, at the both end portions of the upper surface of the main wall 113 in the left-right direction 9, protruding portions 115A, 115B, 116A, and 116B are provided. The protruding portions 115A and 115B are provided at the right end of the upper surface of the main wall 113 to be separated from each other in the front-rear direction 8. The protruding portions 116A and 116B are provided at the left end of the upper surface of the main wall 113 to be separated from each other in the front-rear direction 8.

The inner guide member 19 is provided at a rear end portion of the main wall 113 in the front-rear direction 8. The sheet 12 supported by the feeding tray 20 is guided by the inner guide member 19 from the lower surface of the main wall 113 to the upper surface side of the main wall 113. Furthermore, the sheet 12 is guided to the front side in the front-rear direction 8 along the upper surface of the main wall 113 and the lower surface of the main wall 114. To put it differently, the curved conveyance passage 33 is curved along the rear end portion of the main wall 113, from the lower surface side of the main wall 113 to the upper surface side of the mail wall 113. The linear conveyance passage 34 is provided to be linear in the front-rear direction 8, on a horizontal surface which extends along the upper surface of the main wall 113 and the lower surface of the main wall 114.

As shown in FIG. 5, to the upper surface of the main wall 113, paired side frames 120 and 130 are attached to be separated from each other in the left-right direction 9. These side frames 120 and 130 are formed by sheet metal working. The side frame 120 is formed by combining a plate-shaped base portion 121 with a supporting wall 122 to substantially form an L-shape in cross section in the transverse direction. The side frame 130 is formed by combining a plate-shaped base portion 131 with a supporting wall 132 to substantially form an L-shape in cross section in the transverse direction.

The base portion 121 is attached to the upper surface of the main wall 113 with the longitudinal direction thereof extending in the front-rear direction 8. In the base portion 121, through holes 123A and 123B are formed to be separated from each other in the front-rear direction 8. The side frame 120 is attached to the main wall 113 while the protruding portions 115A and 115B are inserted into the through holes 123A and 123B, respectively. As such, the side frame 120 is positioned with respect to the main wall 113 in the front-rear direction 8 and the left-right direction 9.

The supporting wall 122 is provided to protrude from one end portion in the transverse direction of the base portion 121. To put it differently, the supporting wall 122 after the side frame 120 is attached to the main wall 113 protrudes upward and extends in the front-rear direction 8. The supporting wall 122 is provided with protruding pieces 124 and 125 which protrude upward and a first receiving portion 126 and a second receiving portion 127 which penetrate the supporting wall 122 in the thickness direction and are separated from each other in the longitudinal direction of the side frame 120. In the supporting wall 122 after the side frame 120 is attached to the main wall 113, the protruding piece 124, the first receiving portion 126, the second receiving portion 127, and the protruding piece 125 are provided in this order from the rear side to the front side in the front-rear direction 8.

The structure of the side frame 130 is identical with that of the side frame 120. That is to say, the base portion 131 has through holes 133A and 133B. Furthermore, the supporting wall 132 is provided with protruding pieces 134 and 135 and a first receiving portion 136 and a second receiving portion 137. On this account, after the side frames 120 and 130 are attached to the main wall 113, the supporting walls 122 and 132 oppose each other in the left-right direction 9. To be more specific, in the front-rear direction 8, the protruding pieces 124 and 134 oppose each other, the protruding pieces 125 and 135 oppose each other, the first receiving portions 126 and 136 oppose each other, and the second receiving portions 127 and 137 oppose each other.

Figure 6:
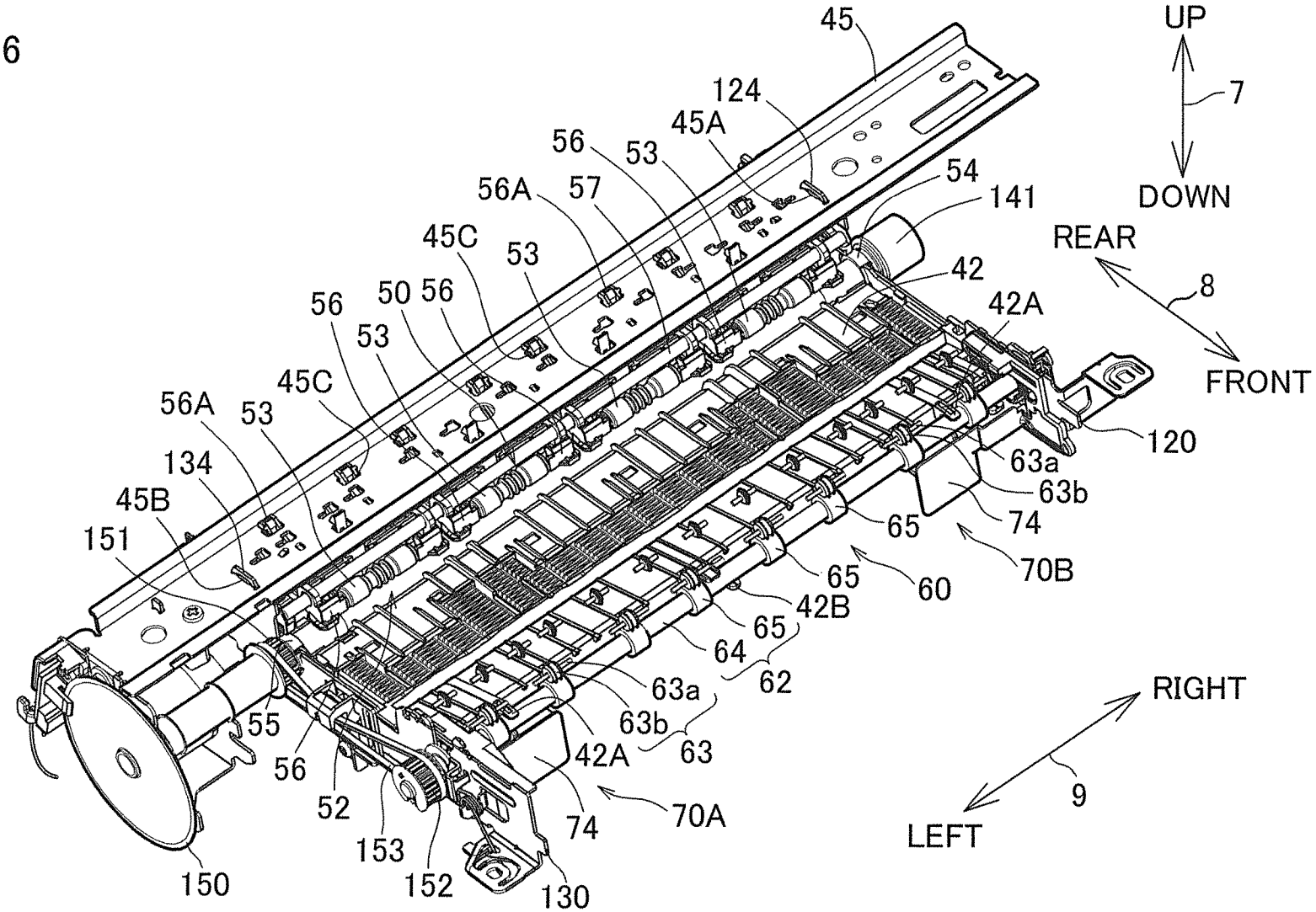
FIG. 6 is an oblique perspective of a guide rail supported by the side frame, a registration roller pair, a platen, a discharge roller pair, a release rod, and the side frame.

As shown in FIG. 6, the guide rail 45 is supported by the side frames 120 and 130. To be more specific, the guide rail 45 has through holes 45A and 45B which are separated from each other in the left-right direction 9 and penetrate the guide rail 45 in the thickness direction (in the up-down direction 7 in FIG. 6). These through holes 45A and 45B are positioned to correspond to the protruding pieces 124 and 134 of the side frames 120 and 130 and are shaped to correspond to the protruding pieces 124 and 134. For this reason, when the guide rail 45 is supported by the upper ends of the side frames 120 and 130, the protruding pieces 124 and 134 are inserted into the respective through holes 45A and 45B. As such, the guide rail 45 is positioned with respect to the side frames 120 and 130 in the front-rear direction 8 and the left-right direction 9.

In addition to the above, although not shown in the figures, as with the guide rail 45, the guide rail 46 is supported by the upper ends of the side frames 120 and 130 and is positioned in the front-rear direction 8 and the left-right direction 9 by the protruding pieces 125 and 135. That is to say, the guide rails 45 and 46 are supported by the side frames 120 and 130 to be separated from each other in the front-rear direction 8, and each of which extends in the left-right direction 9.

As shown in FIG. 6, to the registration roller 52, bearings 54 and 55 are externally fitted to be separated from each other in the axial direction (left-right direction 9). To be more specific, the bearings 54 and 55 are externally fitted to the registration roller 52, at positions corresponding to the first receiving portions 126 and 136 of the side frames 120 and 130. The bearing 54 is supported by the first receiving portion 126 of the side frame 120, whereas the bearing 55 is supported by the first receiving portion 136 of the side frame 130.

The registration roller pair 50 includes pinch rollers 53 which are separated from one another in the left-right direction 9. The pinch rollers 53 are rotatably supported by the four roller holders 56, respectively. Each roller holder 56 includes an engaging portion 56A. The engaging portion 56A passes a through hole 45C penetrating the guide rail 45 in the thickness direction and is engaged with the upper surface of the guide rail 45. In other words, each roller holder 56 is supported by the guide rail 45.

Between the guide rail 45 and each roller holder 56, a coil spring 58 (see FIG. 11B) which biases each roller holder 56, i.e., each pinch roller 53 toward the registration roller 52 is provided. The coil spring 58 biases the roller holder 56 downward to press each pinch roller 53 onto the registration roller 52.

In addition to the above, into a hole 56C (see FIG. 11B) formed in each roller holder 56, a release shaft 57 is inserted. The release shaft 57 is provided along the shaft member 52*a* of the registration roller 52 to be movable in the radial directions. The release shaft 57 is provided at a position different from the position of the pinch rollers 53 in the front-rear direction 8. To be more specific, the release shaft 57 is positioned on the upstream in the conveyance direction 15 of the pinch rollers 53. In the upward movement, the release shaft 57 contacts with a wall surface of the roller holder 56 defining the hole 56C so as to move each roller holder 56 upward against the biasing force of the coil spring 58. To put it differently, each pinch roller 53 is arranged to be radially movable.

As shown in FIG. 6, the discharge roller 62 is constituted by a shaft member 64 and rollers 65 which are externally fitted to the shaft member 64 to be separated from one another in the axial direction. The shaft member 64 is rotatably supported by the side frames 120 and 130 via unillustrated bearings which are externally fitted to be separated from one another in the axial direction. To be more specific, the bearings externally fitted to the shaft member 64 are supported by the second receiving portions 127 and 137 of the side frames 120 and 130 (corresponding to supporting members) to allow the discharge roller 62 to be radially movable. With this arrangement, the discharge roller 62 is able to take a conveyance position (shown in FIG. 11A and FIG. 11B) where the discharge roller 62 contacts with the spur rollers 63 and a retracted position (shown in FIG. 12A and FIG. 12B) where the discharge roller 62 is separated from the spur rollers 63. The conveyance position is a position where the discharge roller pair 60 is able to convey the conveyed sheet 12 while holding the same. The retracted position is a position where the discharge roller 62 is separated from the spur rollers 63, and the holding force of the discharge roller pair 60 for holding the sheet 12 is smaller than the holding force in the conveyance position. Furthermore, to the shaft member 64, two gears 64*a* are fixed at around the end portions in the axial direction (see FIG. 9 to FIG. 12B). Each gear 64*a* is positioned at around the bearing which is externally fitted to the shaft member 64 and is on the inner side of the bearing in the axial direction. The shaft member 64 is biased upward by a coil spring 67 (corresponding to a biasing component; see FIG. 11A). To put it differently, the discharge roller 62 is biased toward the spur rollers 63. The spur rollers 63 are positioned to correspond to the respective rollers 65 of the discharge roller 62. The shaft member 66 of each spur roller 63 is rotatably supported by a supporting plate 68 (see FIG. 11A). This supporting plate 68 is supported by the guide rail 46.

The guide rails 45 and 46, the registration roller pair 50, and the discharge roller pair 60 are supported by the side frames 120 and 130. The carriage 40 (i.e., the recording unit 24) is supported by the side frames 120 and 130 via the guide rails 45 and 46. In other words, the guide rails 45 and 46, the registration roller pair 50, the recording unit 24, and the discharge roller pair 60 are supported by the main wall 113 of the base 100 via the side frames 120 and 130. In the meanwhile, the feeding unit 16 is directly supported by the main wall 113.

As shown in FIG. 6, at the front end portion of the platen 42, engaging portions 42A and 42B are provided. The engaging portions 42A and 42B are separated from one another in the longitudinal direction of the platen 42 (i.e., in the left-right direction 9). To be more specific, the engaging portions 42A protrude forward from the both edges in the longitudinal direction of the platen 42. In the meanwhile, the engaging portion 42B protrudes forward from a central part in the longitudinal direction of the platen 42. The engaging portions 42A contact from above with the outer surface of the shaft member 64 of the discharge roller 62. The engaging portion 42B contacts from below with the outer surface of the shaft member 64 of the discharge roller 62. In other words, the engaging portions 42A and 42B sandwich the shaft member 64 of the discharge roller 62 in the up-down direction 7. To put it differently, the platen 42 is supported by the shaft member 64 of the discharge roller 62.

In addition to the above, at the rear end portion of the platen 42, as shown in FIG. 11A, protruding pieces 42C are provided to protrude rearward. To be more specific, the protruding pieces 42C protrude rearward from the both ends in the longitudinal direction of the platen 42. Each of these protruding pieces 42C contacts at its upper surface with the outer surface of the bearing 54 or 55 of the registration roller 52, and receives at its lower surface a biasing force of an unillustrated coil spring. To put it differently, the protruding pieces 42C are biased upward by the coil springs while the upward movement of the protruding pieces 42C is restricted by the bearings 54 and 55.

In addition to the above, as shown in FIG. 6, release rods 70A and 70B (corresponding to movable members) are provided along the side frames 120 and 130. To be more specific, the release rod 70A is provided on the upper surface of the base portion 131 of the side frame 130 to extend in the front-rear direction 8 along the right surface of the supporting wall 132 of the side frame 130. The release rod 70B is provided on the upper surface of the base portion 121 of the side frame 120 to extend in the front-rear direction 8 along the left surface of the supporting wall 122 of the side frame 120. The release rods 70A and 70B are arranged to be movable in the front-rear direction 8 along the side frames 120 and 130.

As shown in FIG. 8A and FIG. 8B, the release rod 70A includes a base portion 71, a first contact portion 72, a second contact portion 73, and a grip 74. Because the release rods 70A and 70B are identically structured except that the mounting positions of the first contact portion 72, the second contact portion 73, and the grip 74 with respect to the base portion 71 are opposite between the release rods 70A and 70B, the following will solely describe the release rod 70A. In the following description of the members of the release rod 70A, the directions when the release rod 70A is attached to the multifunction machine 10 (i.e., the up-down direction 7, the front-rear direction 8, and the left-right direction 9) will be used.

The base portion 71 is a plate-shaped member which extends in the front-rear direction 8 and the left-right direction 9. The base portion 71 is a long member and is longer in the front-rear direction 8 than in the left-right direction 9. The base portion 71 is positioned to be substantially in parallel to the base portion 131 of the side frame 130. For this reason, as the release rod 70A moves in the front-rear direction 8, the base portion 71 moves along the upper surface of the base portion 131 of the side frame 130.

The first contact portion 72 is a plate-shaped member which extends in the up-down direction 7 and the front-rear direction 8. The first contact portion 72 extends in the thickness direction of the base portion 71 (i.e., upward in the up-down direction 7) at a position which is one end in the longitudinal direction of the base portion 71 (i.e., at the tail end in the front-rear direction 8) and one end in the transverse direction of the base portion 71 (i.e., the left end in the left-right direction 9). To put it differently, the base portion 71 and the first contact portion 72 extend in intersecting directions.

The first contact portion 72 is constituted by a proximal end portion 75 which protrudes upward from the base portion 71 and a leading end portion 76 which protrudes forward from the upper end of the proximal end portion 75. The leading end portion 76 includes a bearing contact portion 77 which contacts with the outer surface of the bearing 55 supporting the shaft member 52*a* of the registration roller 52 and a shaft contact portion 78 which contacts with the outer surface of the release shaft 57. The bearing contact portion 77 is provided at a lower part of the leading end portion 76 whereas the shaft contact portion 78 is provided at an upper part of the leading end portion 76.

The upper surface of the shaft contact portion 78 is constituted by a first surface 78A, a second surface 78B, and a slope 78C. The first surface 78A and the second surface 78B are provided to be separated from each other in the up-down direction 7 and the front-rear direction 8 and each extends substantially on a horizontal plane. To be more specific, the first surface 78A is positioned to the front of and below the second surface 78B. For this reason, in the up-down direction 7, the second surface 78B is farther from the bearing contact portion 77 than the first surface 78A. The slope 78C connects the tail end of the first surface 78A with the leading end of the second surface 78B. The slope 78C is inclined upward from the first surface 78A to the second surface 78B (i.e., inclined rearward).

The second contact portion 73 is a plate-shaped member extending in the up-down direction 7 and the front-rear direction 8. The second contact portion 73 extends in the thickness direction of the base portion 71 (i.e., upward in the up-down direction 7) at a position which is the other end in the longitudinal direction of the base portion 71 (i.e., the leading end in the front-rear direction 8) and one end in the transverse direction of the base portion 71 (i.e., the left end in the left-right direction 9). In other words, the base portion 71 and the second contact portion 73 extend in intersecting directions. The first contact portion 72 and the second contact portion 73 extend to be substantially in parallel to each other. (To be more specific, these portions 72 and 73 are substantially on the same plane).

The second contact portion 73 (corresponding to a main body portion) has a through hole 79 (corresponding to a guiding member) which penetrates the second contact portion 73 in the thickness direction (i.e., in the left-right direction 9). Into this through hole 79, the shaft member 64 of the discharge roller 62 is inserted. The wall surface defining the upper edge of the through hole 79 includes a retaining surface 79A and a guide surface 79B. The retaining surface 79A is positioned at the leading end of the upper edge of the through hole 79 and is substantially horizontal. The guide surface 79B is connected to the leading end of the retaining surface 79A and is inclined so that the rear side is lower than the front side.

In addition to the above, the second contact portion 73 has an engaging portion 73*a* which protrudes rightward from a position above the retaining surface 79A and the guide surface 79B. The engaging portion 73*a* is constituted by a rack gear having teeth 73*a*1 on its lower surface. The engaging portion 73*a* is positioned to overlap the discharge roller 62 in the up-down direction 7 and to allow the teeth 73*a*1 to be engaged with the gear 64*a* fixed to the shaft member 64, when the discharge roller pair 60 takes the retracted position (i.e., the release rods 70A and 70B take a later-described second position).

The grip 74 is a plate-shaped member which extends in the up-down direction 7 and the left-right direction 9. The grip 74 protrudes rightward from a position which is the other end in the longitudinal direction of the base portion 71 (i.e., the leading end in the front-rear direction 8) and the other end in the transverse direction of the base portion 71 (i.e., the right end in the left-right direction 9). That is to say, the grip 74 extends in a direction intersecting with the base portion 71, the first contact portion 72, and the second contact portion 73. Furthermore, as shown in FIG. 7, the grip 74 is exposed to the tray housing space 107.

With this, the user is able to grip the grip 74 through the opening 13 by pulling out the feeding tray 20 and the discharge tray 21 from the tray housing space 107. To be more specific, by putting his/her hand into the tray housing space 107 through the opening 13 and gripping the grip 74, the user is able to draw out the release rod 70A at the first position forward (i.e., toward the opening 13) and move the release rod 70A to the second position. In other words, the release rods 70A and 70B are arranged to be movable between the first and second positions. When the release rods 70A and 70B are in the first position, the registration roller 52 and each pinch roller 53 contact with each other, and each roller 65 of the discharge roller 62 and the spur 63*a* of each spur roller 63 contact with each other. The first position is a position shown in FIG. 11A and FIG. 11B and where the registration roller pair 50 and the discharge roller pair 60 take the conveyance position. In the meanwhile, when the release rods 70A and 70B are in the second position, the registration roller 52 and each pinch roller 53 are separated from each other, and each roller 65 of the discharge roller 62 and the spur 63*a* of each spur roller 63 are separated from each other. The second position is a position shown in FIG. 12A and FIG. 12B and where the registration roller pair 50 and the discharge roller pair 60 take the retracted position. While FIG. 9 to FIG. 12B referred to in the description below only show the release rod 70B, the release rod 70A is structured in the same manner.

When the release rods 70A and 70B are positioned in the first position, as shown in FIG. 9 and FIG. 11A, the release shaft 57 is supported by the first surface 78A of the shaft contact portion 78. That is to say, the first surface 78A of the release rod 70A in the first position contacts with the outer surface on one end side in the axial direction of the release shaft 57 (i.e., the left side in the left-right direction 9). In the meanwhile, the first surface 78A of the release rod 70B in the first position contacts with the outer surface on the other end side in the axial direction of the release shaft 57 (i.e., the right side in the left-right direction 9). Furthermore, as shown in FIG. 9 and FIG. 11A, the shaft member 64 of the discharge roller 62 does not contact with the retaining surface 79A and the guide surface 79B in the through holes 79 of the release rods 70A and 70B. With this, as shown in FIG. 11A and FIG. 11B, the registration roller 52 and each pinch roller 53 contact with each other and the roller 65 of the discharge roller 62 and the spur 63*a* of each spur roller 63 contact with each other. The platen 42 is maintained to be substantially horizontal.

Subsequently, when the release rods 70A and 70B are pulled out to the second position by the user for the purpose of jamming treatment or the like, the first contact portion 72 enters the space which is between the bearing 55 of the registration roller 52 and the release shaft 57 in the up-down direction 7. To put it differently, the bearing 55 enters the space defined by the base portion 71, the proximal end portion 75, and the leading end portion 76. Thereafter, as shown in FIG. 10 and FIG. 12A, the bearing contact portion 77 contacts from above with the outer surface of the bearing 55. In other words, the bearing contact portion 77 of the release rod 70A in the second position contacts with the outer surface of the bearing 55 supporting one end side of the shaft member 52*a*. In the meanwhile, the bearing contact portion 77 of the release rod 70B in the second position contacts with the outer surface of the bearing 54 supporting the other end side of the shaft member 52*a*.

Furthermore, during the process of pulling out the release rods 70A and 70B to the second position, the release shaft 57 moves on the slope 78C from the first surface 78A side to the second surface 78B side. Once the release rods 70A and 70B reach the second position, the release shaft 57 is supported by the second surface 78B as shown in FIG. 10 and FIG. 12A. In other words, the second surface 78B of the release rod 70A in the second position contacts with the outer surface on one end side in the axial direction of the release shaft 57. In the meanwhile, the second surface 78B of the release rod 70B in the second position contacts with the outer surface on the other end side in the axial direction of the release shaft 57.

In the process of the upward movement of the release shaft 57 along the slope 78C, the release shaft 57 contacts with a wall surface defining the hole 56C of each roller holder 56 and moves the roller holder 56 upward against the biasing force of the coil spring 58. This causes the pinch rollers 53 to move upward together with the roller holder 56, and the pinch rollers 53 take the retracted position of being separated from the registration roller 52 when the release rods 70A and 70B reach the second position, as shown in FIG. 12B. In other words, when the release rods 70A and 70B move from the first position to the second position, the registration roller pair 50 is switched from the conveyance position to the retracted position. The conveyance position is a position where the registration roller pair 50 is able to convey a conveyed sheet 12 while holding the same, whereas the retracted position is a position where the registration roller 52 is separated from the pinch rollers 53 and the holding force of the registration roller pair 50 for holding the sheet 12 is smaller than the holding force in the conveyance position.

In addition to the above, in the process of pulling out the release rods 70A and 70B to the second position, the shaft member 64 of the discharge roller 62 moves rearward in the through hole 79 and contacts with the guide surface 79B. Then the shaft member 64 of the discharge roller 62 is guided by the guide surface 79B and moves downward against the biasing force of the coil spring 67. Once the release rods 70A and 70B reach the second position, the shaft member 64 of the discharge roller 62 is supported by the retaining surface 79A (i.e., the upward movement due to the biasing force of the coil spring 67 is restricted). With this, as shown in FIG. 12A and FIG. 12B, the roller 65 of the discharge roller 62 is separated from the spur rollers 63 and the discharge roller pair 60 takes the retracted position.

In addition to the above, in the process of pulling out the release rods 70A and 70B to the second position, the platen 42 rotates in such a way that the rotating leading end of the platen 42 moves downward together with the shaft member 64 of the discharge roller 62, provided that the upstream end portion in the conveyance direction 15 of the plate 42 is the rotational center whereas the downstream end portion in the conveyance direction 15 of the plate 42 supported by the shaft member 64 of the discharge roller 62 is the rotating leading end. Once the release rods 70A and 70B reach the second position, the downstream end portion in the conveyance direction 15 of the platen 42 is below the upstream end portion thereof, as shown in FIG. 12A and FIG. 12B. To put it differently, the platen 42 is sloped downward in the conveyance direction 15.

As such, when the user moves the release rods 70A and 70B from the first position to the second position, the two rollers constituting each of the registration roller pair 50 and the discharge roller pair 60 are separated from each other. This makes it possible to cancel the nipping by the registration roller pair 50 and the discharge roller pair 60, with the result that the sheet 12 becomes easily removable from the rollers.

Now, an operation to return the release rods 70A and 70B from the second position to the first position will be described. For example, when the sheet 12 conveyed for image recording is jammed in the conveyance passage 35, the user moves the release rods 70A and 70B from the first position to the second position and performs jamming treatment for removing the jammed sheet 12 as described above. After this jamming treatment, a sheet 12 is re-conveyed from the feeding tray 20. When the release rods 70A and 70B are in the second position, the registration roller pair 50 and the discharge roller pair 60 are in the retracted position.

When the sheet 12 is conveyed from the feeding tray 20, in the conveyor 1 of the present embodiment, the conveyance motor 2 is controlled by the controller 180 to drive backward. With this, the feed roller 25 rotates clockwise in FIG. 2 and the sheet 12 is conveyed to the conveyance passage 35. At this stage, the discharge roller pair 60 also rotates to convey the sheet 12 in the direction opposite to the conveyance direction 15. To be more specific, the shaft member 64 rotates counterclockwise in FIG. 2, which is indicated by the arrow 6 in FIG. 10. The engaging portions 73*a* of the release rods 70A and 70B at this stage are engaged with the gears 64*a*. Therefore, on account of the rotation of the gears 64*a*, the release rods 70A and 70B move rearward in the front-rear direction 8. In other word, the release rods 70A and 70B move from the second position to the first position. As the release rods 70A and 70B move from the second position to the first position in this manner, an operation opposite to the movement of the release rods 70A and 70B from the first position to the second position described above is carried out, i.e., the registration roller pair 50 and the discharge roller pair 60 return from the retracted position to the conveyance position. The platen 42 also returns to the original position.

According to a modification, the positional relationship between the engaging portion 73*a* and the gear 64*a* which are engaged with each other may be arranged in such a way that the backward drive of the conveyance motor 2 moves the release rods 70A and 70B only to an intermediate position between the second position and the first position. In this case, the shaft member 64 contacts with the guide surface 79B (slope) at the intermediate position. As the inclined part of this guide surface 79B is pressed by the shaft member 64 which is biased by the coil spring 67, the release rods 70A and 70B automatically move from the intermediate position to the first position. Also in this case, the registration roller pair 50 and the discharge roller pair 60 return from the retracted position to the conveyance position in the same manner as above.

In addition to the above, the registration roller pair 50 returns to the conveyance position before the leading end of the sheet 12 conveyed by the feed roller 25 reaches the registration roller pair 50. This allows the registration roller pair 50 to perform skew correction of the leading end of the sheet 12.

Thereafter, the controller 180 drives the conveyance motor 2 forward. With this, the registration roller pair 50 and the discharge roller pair 60 convey the sheet 12 in the conveyance direction 15. At this stage, the controller 180 controls the carriage drive motor 40M and the record head 38 to record an image on the sheet 12 supported by the platen 42. As such, the sheet 12 is conveyed from the feeding tray 20 after the jamming treatment, and the sheet 12 on which the image has been recorded by the recording unit 24 is discharged to the discharge tray 21.

As described above, in the conveyor 1 of the present embodiment, the release rods 70A and 70B are moved from the second position to the first position by the rotation of the discharge roller 62 in one direction (which is indicated by the arrow 6 and is a direction with which the sheet 12 is conveyed in the direction opposite to the conveyance direction 15), when the sheet 12 is conveyed. For this reason, even if the registration roller pair 50 (the registration roller 52 and the pinch rollers 53) and the discharge roller pair 60 (the discharge roller 62 and the spur rollers 63) take the retracted position, these roller pairs 50 and 60 take the conveyance position when the sheet 12 is conveyed. This makes it possible to properly convey the sheet 12.

For biasing the discharge roller 62 toward the spur rollers 63, the coil spring 67 is provided. The coil spring 67 is compressed when the release rods 70A and 70B are in the second position, as compared to the first position. To put it differently, the force of the coil spring 67 pressing the discharge roller 62 with respect to the release rods 70A and 70B is larger in the second position than in the first position. For this reason, the friction force between the gear 64*a* and the engaging portion 73*a* is larger in the second position than in the first position. The rotational force in one direction from the discharge roller 62 (indicated by the arrow 6 in FIG. 10) is therefore effectively transmitted to the release rods 70A and 70B, and this facilitates the movement of the release rods 70A and 70B from the second position to the first position.

According to another modification, the gear 64*a* and the engaging portion 73*a* may not be provided. Also in this case, the friction force between the shaft member 64 and the retaining surface 79A is larger in the second position than in the first position, on account of the coil spring 67. The rotational force in one direction from the discharge roller 62 (indicated by the arrow 6 in FIG. 10) is therefore effectively transmitted to the release rods 70A and 70B. As a result, the release rods 70A and 70B are moved from the second position to the first position solely by the one-directional rotation of the discharge roller 62.

Because the release rods 70A and 70B are provided with the engaging portions 73*a* which are engaged with the gears 64*a* of the discharge roller 62 in the second position, the release rods 70A and 70B are certainly moved from the second position to the first position.

Each of the release rods 70A and 70B has the through hole 79 including the retaining surface 79A and the guide surface 79B. On this account, the discharge roller 62 and the spur rollers 63 certainly take the retracted position when the release rods 70A and 70B move from the first position to the second position, and the discharge roller 62 and the spur rollers 63 certainly take the conveyance position when the release rods 70A and 70B move from the second position to the first position.

When the sheet 12 is conveyed by the feed roller 25, the transmission mechanism 3 rotates the discharge roller 62 in one direction (indicated by the arrow 6). With this arrangement, even if the registration roller pair 50 and the discharge roller pair 60 take the retracted position, the roller pairs 50 and 60 take the conveyance position when the sheet 12 is conveyed by the feed roller 25. This makes it possible to properly convey the sheet 12.

In the embodiment above, by suitably combining the rotational directions of the roller pairs 50 and 60 and the feed roller 25, the release rods 70A and 70B return to the first position and the roller pairs 50 and 60 return to the conveyance position when the sheet 12 is conveyed from the feeding tray 20, even if the release rods 70A and 70B are in the second position and the roller pairs 50 and 60 are in the retracted position. Alternatively, the roller pairs 50 and 60 and the feed roller 25 may be individually driven. In such a case, the controller 180 drives only the conveyance motor corresponding to the discharge roller 62 to cause the discharge roller 62 to rotate in the direction with which the sheet 12 is conveyed in the direction opposite to the conveyance direction 15, before driving the conveyance motors corresponding to the roller pairs 50 and 60 and the feed roller 25 based on a conveyance instruction of conveying the sheet 12. This makes it possible to certainly return the release rods 70A and 70B to the first position and return the roller pairs 50 and 60 to the conveyance position, without considering the combination of the rotational directions of the feed roller 25 and the discharge roller 62. An effect similar to that of the embodiment above is achieved by this arrangement.

According to another modification, as indicated by broken lines in FIG. 4, a plurality of sheet sensors 185 and a tray attaching sensor 186 may be additionally provided. The plurality of sheet sensors 185 are provided along the conveyance passage 35 to detect the leading end of the conveyed sheet 12 and output a sheet detection signal to the controller 180. Based on the sheet detection signal from each sheet sensor 185, the controller 180 performs determination for jamming detection. That is to say, the controller 180 determines that sheet jamming has occurred in the conveyance passage 35 when a time interval between the first output of the sheet detection signal from the sheet sensor 185 and the output of the sheet detection signal from the next sheet sensor exceeds a predetermined time interval. As such, the sheet sensors 185 and the controller 180 constitute a jamming detection unit. The tray attaching sensor 186 detects a change from the state that the feeding tray 20 is attached (first state) to the state that the feeding tray 20 is not attached (second state) and a change of the state of the feeding tray 20 from the second state to the first state, and outputs, to the controller 180, a signal indicating a change in the attaching state of the feeding tray 20.

When the controller 180 determines that jamming has occurred during the conveyance of the sheet, the controller 180 controls an unillustrated notifying unit (e.g., a buzzer) to notify the user of the occurrence of the jamming. When notified the occurrence of the jamming, the user detaches the feeding tray 20 and moves the release rods 70A and 70B to the second position. As such, the jammed sheet 12 is removed. Thereafter, the user attached the feeding tray 20. At this stage, the tray attaching sensor 186 outputs, to the controller 180, a signal indicating a change from the second state to the first state. When the jamming is detected and the signal indicating the change from the second state to the first state is output from the tray attaching sensor 186, the controller 180 determines that the treatment of the jamming of the sheet 12 has been completed. As such, the tray attaching sensor 186 and the controller 180 constitute a jamming treatment completion detection unit. When it is determined that the jamming treatment has been completed, the controller 180 controls the conveyance motor 2 to rotate the discharge roller 62 in one direction (indicated by the arrow 6). With this arrangement, when the feeding tray 20 is attached after the jamming treatment, the release rods 70A and 70B are moved from the second position to the first position when the release rods 70A and 70B are in the second position. This makes it possible to properly convey the sheet 12. The jamming treatment completion detection unit may be a push button switch provided on the outer cover 14 of the multifunction machine 10. In summary, the jamming treatment completion detection unit may be variously arranged on condition that, after the jamming treatment, a signal indicating that the feeding tray 20 is attached and the jamming treatment is completed is output to the controller 180. Alternatively, as the jamming treatment completion detection unit, a sensor configured to detect the opening and closing of the outer guide member 18 is provided, and a signal indicating that the state of the outer guide member 18 has been changed from the open state to the closed state is output from the sensor to the controller. This also makes it possible to detect the completion of the jamming treatment of removing the jammed sheet 12 from the outer guide member 18 side.

In addition to the above, the gear 64*a* may be provided on the shaft member 52*a* of the registration roller 52, in place of the discharge roller 62. In this case, the engaging portion 73*a* is preferably positioned to be engaged with this gear 64*a* when the release rods 70A and 70B are in the second position. Furthermore, the discharge roller pair 60 may not be provided. In this case, the gear 64*a* is provided on the shaft member 52*a* of the registration roller 52 as described above, and the engaging portion 73*a* is positioned to be engaged with the gear 64*a* when the release rods 70A and 70B are in the second position. An effect similar to the above is achieved by this arrangement.

In addition to the above, in place of the gear 64*a*, a high-friction member having a higher friction coefficient with respect to the wall surface of the through hole 79 than the outer circumferential surface of the shaft member 64 may be provided at a position which is a part of the outer circumferential surface of the shaft member 64 and opposes the wall surface of the through hole 79. An effect similar to the above is achieved by this arrangement. Furthermore, when the release rods which are the movable members move from the first position to the second position, either the spur rollers 63 or both of the discharge roller 62 and the spur rollers 63 may be moved to the retracted position. According to another modification, when the movable members move from the first position to the second position, either the registration roller 52 or both of the registration roller 52 and the pinch rollers 53 are moved to the retracted position.

While in the embodiment above the discharge roller 62 is employed as a conveyor roller unit and the spur rollers 63 are employed as a driven roller unit, each roller unit may include another supporting member (e.g., a roller holder 56, a release shaft 57, or the like) for supporting the shaft member of each roller. In this case, as the supporting member is replaced with the shaft member and the release rods 70A and 70B which are the movable members are moved, the switching from the conveyance position to the retracted position is achieved as in the embodiment and the modifications above.

According to another modification, the coil spring 67 may not be provided. In this case, the relationship between the discharge roller 62 and the spur rollers 63 turns upside down, and the discharge roller 62 returns from the refracted position to the conveyance position by its own weight. The coil spring 67 may be constituted by another elastic member.

According to another modification, the release rods 70A and 70B which are the movable members may be movable from the first position to the second position when the outer guide member 18 is in the closed state.

The present invention can be employed not only in multifunction machines but also in line-type or serial-type inkjet printers and laser-type or thermal-type recording apparatuses. Furthermore, the sheet 12 is not limited thereto as long as it is sheet-shaped.

While the registration roller pair 50 above is arranged to have a function of correcting the skew of the sheet 12, the registration roller pair 50 may be a conveyor roller pair which simply conveys the sheet 12 in the conveyance direction 15.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A conveyor comprising:

a drive motor;

a conveyor roller unit including a conveyor roller;

a transmission mechanism configured to transmit a driving force from the drive motor to the conveyor roller;

a driven roller unit including a driven roller which opposes the conveyor roller and is configured to convey a sheet while holding the sheet with the conveyor roller;

a supporting member which supports the conveyor roller unit and the driven roller unit to allow the conveyor roller unit and the driven roller unit to take a conveyance position where the conveyor roller and the driven roller convey the sheet while holding the sheet or a retracted position where a holding force by which the sheet is held by the conveyor roller and the driven roller is smaller than a holding force in the conveyance position; and a movable member which is engaged with at least the conveyor roller unit among the conveyor roller unit and the driven roller unit and is movable between a first position where the conveyor roller and the driven roller take the conveyance position and a second position where the conveyor roller and the driven roller take the retracted position, wherein:

when the movable member is at the second position and the conveyor roller is rotated in one direction, the conveyor roller engages the movable member to move the movable member from the second position to the first position by the driving force of the conveyor roller;

when the movable member is at the first position and the conveyor roller is rotated in a direction opposite the one direction, the conveyor roller does not engage the movable member so that the movable member is retained at the first position.

2. The conveyor according to claim 1, further comprising:

a biasing component which biases the conveyor roller toward the driven roller, the movable member contacting with the conveyor roller at least when the movable member is in the second position, and a pressing force of the biasing component biasing the conveyor roller with respect to the movable member is larger in the second position than in the first position.

3. The conveyor according to claim 1, wherein, the conveyor roller includes a shaft member and a gear positioned on the shaft member, the movable member includes a main body portion which is able to contact with the shaft member and an engaging portion which protrudes from the main body portion in a direction in which the shaft member extends and is engaged with the gear when the movable member is in the second position, and when engaged with the gear, the engaging portion moves from the second position to the first position together with the main body portion, as the gear rotates in the one direction.

4. The conveyor according to claim 3, wherein, the main body portion includes a guiding member which guides the shaft member to cause the conveyor roller and the driven roller to take the conveyance position in accordance with movement from the second position to the first position, and guides the shaft member to cause the conveyor roller and the driven roller to take the retracted position in accordance with movement from the first position to the second position.

5. The conveyor according to claim 1, further comprising:

a feed roller configured to convey the sheet toward the conveyor roller, when the sheet is conveyed by the feed roller, the transmission mechanism transmitting the driving force from the drive motor to the feed roller and rotating the conveyor roller in the one direction.

6. The conveyor according to claim 1, further comprising:

a controller configured to control the drive motor, before controlling the drive motor based on a conveyance instruction instructing to convey the sheet by the conveyor roller, the controller controlling the drive motor to cause the conveyor roller to rotate in the one direction which is opposite to a direction in which the conveyor roller conveys the sheet.

7. The conveyor according to claim 1, wherein, in the retracted position, the conveyor roller and the driven roller are separated from each other.

8. The conveyor according to claim 3, wherein, the engaging portion of the movable member is not engaged with the gear when the movable member is in the first position.

9. The conveyor according to claim 1, wherein, the conveyor roller and the driven roller are configured to move in an up-down direction; and the movable member is configured to move in a direction orthogonal to the up-down direction.

10. The conveyor according to claim 1, further comprising:

a registration roller;

a pinch roller which opposes the registration roller;

the registration roller and the pinch roller being movable between a conveyance position in which the registration roller and the pinch roller convey the sheet while holding the sheet, and a retracted position where a holding force by which the sheet is held by the registration roller and the pinch roller is smaller than a holding force in the conveyance position, wherein the movable member is engaged with at least one of the registration roller and the pinch roller such that the registration roller and the pinch roller take the conveyance position when the movable member is in the first position, and the registration roller and the pinch roller take the retracted position when the movable member is in the second position.

11. The conveyor according to claim 1, wherein, the movable member includes a grip configured to be gripped by a user.

12. The conveyor according to claim 5, wherein, the transmission mechanism is configured such that when the drive motor rotates in a first direction the driving force is transmitted from the drive motor to the feed roller, and when the drive motor rotates in a second direction the driving force is not transmitted from the drive motor to the feed roller.

13. A conveyor comprising:

a drive motor;

a conveyor roller unit including a conveyor roller;

a transmission mechanism configured to transmit a driving force from the drive motor to the conveyor roller;

a driven roller unit including a driven roller which opposes the conveyor roller and is configured to convey a sheet while holding the sheet with the conveyor roller;

a supporting member which supports the conveyor roller unit and the driven roller unit to allow the conveyor roller unit and the driven roller unit to take a conveyance position where the conveyor roller and the driven roller convey the sheet while holding the sheet or a retracted position where a holding force by which the sheet is held by the conveyor roller and the driven roller is smaller than a holding force in the conveyance position;

a movable member which is engaged with at least the conveyor roller unit among the conveyor roller unit and the driven roller unit and is movable between a first position where the conveyor roller and the driven roller take the conveyance position and a second position where the conveyor roller and the driven roller take the retracted position, when the movable member is at the second position and the conveyor roller is rotated in one direction, the conveyor roller engages the movable member to move the movable member from the second position to the first position by the driving force of the conveyor roller;

a jamming detection unit configured to detect jamming of the sheet;

a jamming treatment completion detection unit configured to detect completion of jamming treatment of the sheet; and a controller configured to control the drive motor, the controller controlling the drive motor to cause the conveyor roller to rotate in the one direction, when the jamming treatment completion detection unit detects the completion of the jamming treatment after the jamming detection unit detects the jamming.

* * * * *